US011957992B1

(12) United States Patent
Hwang et al.

(10) Patent No.: US 11,957,992 B1
(45) Date of Patent: Apr. 16, 2024

(54) TOY VEHICLE CARRIER

(71) Applicant: Mattel, Inc., El Segundo, CA (US)

(72) Inventors: Jung Jun Hwang, Inglewood, CA (US); Kar Fai So, Kwai Tsing (HK); Tim Rowe, Lancashire (GB); Paul Martinsen, Asker (NO)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 18/358,165

(22) Filed: Jul. 25, 2023

(51) Int. Cl.
*A63H 17/06* (2006.01)
*A63H 17/00* (2006.01)
*A63H 33/00* (2006.01)

(52) U.S. Cl.
CPC ..... *A63H 17/06* (2013.01); *A63H 17/008* (2013.01); *A63H 33/003* (2013.01)

(58) Field of Classification Search
CPC ..... A63H 17/05; A63H 17/06; A63H 17/008; A63H 17/44; A63H 33/003
USPC ... 446/75, 76, 173, 174, 427, 428, 429, 435, 446/448, 449
See application file for complete search history.

(56) References Cited

U.S. PATENT DOCUMENTS 2,135,850 A * 11/1938 Schmid ..... A63H 13/04 446/288
2,251,006 A * 7/1941 Savage ..... A63H 7/04 446/277
2,600,984 A * 6/1952 Fields ..... A63H 7/04 446/294
3,050,900 A * 8/1962 Kripak ..... A63H 11/10 446/293
3,145,055 A * 8/1964 Carter ..... A63H 17/06 293/134
3,555,722 A * 1/1971 McLain et al. ..... A63H 7/02 446/268
3,675,366 A * 7/1972 Tomiyama ..... A63H 17/06 446/434
3,694,953 A * 10/1972 Tomiyama ..... A63H 17/44 446/423
3,711,990 A * 1/1973 Pfeilsticker ..... A63H 17/06 446/428
3,751,847 A * 8/1973 Neuhierl ..... A63H 18/14 446/429

(Continued)

OTHER PUBLICATIONS

Hot Wheels Toy Car Shark Chomp Transporter & 1:64 Scale Car, Connects to Hot Wheels Track & Stores 5 Scale Vehicles, Amazon.com, Mar. 24, 2023, pp. 1-9, https://www.amazon.com/Hot-Wheels-Shark-Transporter-Playset/dp/B08J4H1VYP/ref=asc_df_B08J4H1VYP/?tag=hyprod-20&linkCode=df0&hvadid=475746621083&hvpos=&hvnetw=g&hvrand=9605585232468946668&hvpone=&hvptwo=&hvqmt=&hvdev=c&hvdvcmdl=&hvlocint=&hvlocphy=1018594&hvtargid=pla-1230840889152&th=1.

*Primary Examiner* — Joseph B Baldori
(74) *Attorney, Agent, or Firm* — Edell, Shapiro & Finnan, LLC

(57) ABSTRACT

A toy vehicle carrier is presented herein. The toy vehicle carrier includes a head, a main body coupled to the head, a base coupled to the main body, and an appendage coupled to the base. The head is configured to capture a toy vehicle in a closed configuration of the head and expel the toy vehicle in an open configuration of the head. The main body is configured to rotate relative to the base to transition the toy vehicle carrier between a first configuration and a second configuration. The toy vehicle carrier also includes a wheel coupled to the base. The wheel includes a protrusion and is configured to rotate about an axis to cause the protrusion to movably engage a camming surface of the appendage to cause the appendage to rotate relative to the base.

24 Claims, 18 Drawing Sheets

(56) References Cited

U.S. PATENT DOCUMENTS 4,192,093 A * 3/1980 Hamano ..... A63H 17/00 446/435
4,505,686 A * 3/1985 Mariol ..... A63H 33/003 446/478
4,568,307 A * 2/1986 Gabler ..... A63H 7/06 446/466
4,576,583 A * 3/1986 Yoneda ..... A63H 17/004 446/457
4,708,683 A * 11/1987 Lehmann ..... A63H 17/05 446/434
4,740,187 A * 4/1988 Rasmussen ..... A63H 17/44 446/268
5,207,333 A * 5/1993 Peng ..... B66F 7/0625 254/9 C
5,334,078 A * 8/1994 Hippely ..... A63H 17/26 446/470
5,626,506 A * 5/1997 Halford ..... A63H 33/003 446/470
5,746,636 A * 5/1998 Cernansky ..... A63H 11/10 446/16
6,520,829 B1 * 2/2003 Temple ..... A63H 17/05 446/434
6,663,464 B2 * 12/2003 Payne ..... A63H 33/28 446/16
7,387,558 B2 * 6/2008 Swisher ..... A63H 17/02 446/470
7,537,509 B2 * 5/2009 Payne ..... A63H 18/023 446/431
7,722,430 B2 * 5/2010 Hippely ..... A63H 29/04 446/431
9,700,809 B1 * 7/2017 Harris ..... A63H 17/05
11,498,012 B2 * 11/2022 Hwang ..... A63H 17/008
2006/0079150 A1 * 4/2006 Filoseta ..... A63H 17/26 446/431
2008/0009219 A1 * 1/2008 Nuttall ..... A63H 18/06 446/435
2014/0051325 A1 * 2/2014 Paukert ..... A63H 33/003 446/376

* cited by examiner

TOY VEHICLE CARRIER

TECHNICAL FIELD

The present application relates generally to toys and, in particular, to a toy vehicle carrier configured to receive, store, and expel toy vehicles.

BACKGROUND

Toys provide entertainment for different users, such as children. For example, a toy may include various features with which a child may play. An example toy that may entertain a child is a toy vehicle, which may emulate the appearance, movement, and/or feel of a real-world vehicle. New toys with new features, such as toys that the child can use to interact with an existing toy vehicle, can provide added play value and provide additional entertainment. Thus, innovative toy advancements are continuously desired.

SUMMARY

A toy vehicle carrier is presented herein. According to one example embodiment, the toy vehicle carrier includes a main body comprising an interior and a head coupled to the main body. The head defines an opening and a passageway, the head is configured to transition between a first configuration and a second configuration and to capture a toy vehicle via the opening and direct the toy vehicle toward the interior of the main body via the passageway in the first configuration, and the head is configured to expel the toy vehicle via the passageway and the opening in the second configuration.

Other systems, methods, features, and advantages will be, or will become, apparent to one with skill in the art upon examination of the following figures and detailed description. All such additional systems, methods, features, and advantages are included within this description and are within the scope of the claimed subject matter.

BRIEF DESCRIPTION OF THE DRAWINGS

The toy vehicle carrier presented herein may be better understood with reference to the following drawings and description. Unless dimensions of elements of the drawings are specifically called-out and described herein, it should be understood that the elements in the figures are not necessarily to scale and that emphasis has been placed upon illustrating the principles of the toy vehicle carrier. In the figures, like-referenced numerals designate corresponding parts throughout the different views.

DETAILED DESCRIPTION

Overall, a toy vehicle carrier is presented herein. The toy vehicle carrier includes a head, a main body coupled to the head, and a base coupled to the main body. The head is configured to transition between a closed configuration and an open configuration. In the closed configuration, the head is configured to capture a toy vehicle via an opening and direct the toy vehicle toward an interior of the main body via a passageway. In the open configuration, the head is configured to expel the toy vehicle via a track that directs the toy vehicle into the passageway and through the opening. The main body is configured to rotate relative to the base to transition the toy vehicle carrier between a first configuration and a second configuration. A wheel with a protrusion is coupled to the base. In each of the first configuration and the second configuration of the toy vehicle carrier, the wheel is configured to rotate about an axis to move the toy vehicle along a surface. Additionally, in the second configuration, rotation of the wheel about the axis causes the protrusion to movably engage an appendage coupled to the base to cause the appendage to rotate relative to the base. The different configurations associated with the toy vehicle carrier therefore can provide different appearances and interactive features to entertain a user (e.g., a child). Additionally, the movability of different toy vehicle carrier components may further entertain the user. Indeed, the interactive engagement between the toy vehicle carrier and a toy vehicle may provide diverse playability and enhance user experience.

Figure 1A:
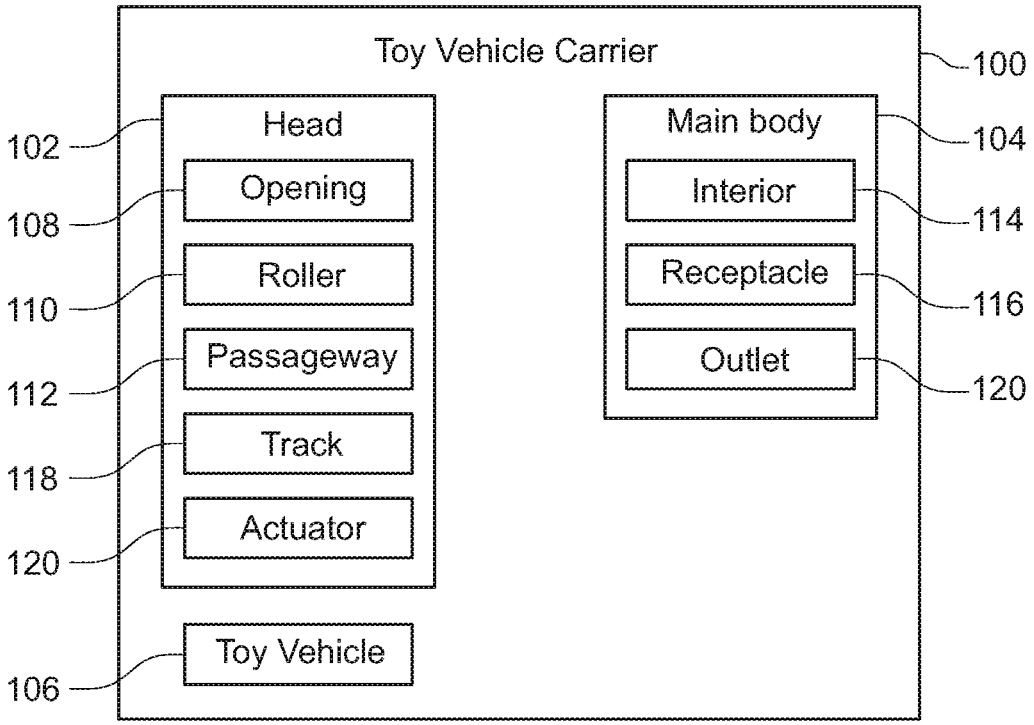
FIGS. 1*a* and 1*b* illustrate schematic diagrams of a toy vehicle carrier in accordance with example embodiments of the present application.

FIG. 1*a* illustrates a schematic diagram of an embodiment of a toy vehicle carrier 100. The toy vehicle carrier 100 includes a head 102 and a main body 104 coupled to one another. The toy vehicle carrier 100 is configured to store or contain a toy vehicle 106 via the head 102 and/or via the main body 104. By way of example, the head 102 includes an opening 108. The toy vehicle 106 may pass the opening 108 to enter the head 102 and into the toy vehicle carrier 100. The head 102 includes a roller 110 configured to facilitate capture of the toy vehicle 106 for intake into the head 102. For instance, as further discussed herein, the roller 110 includes paddles or blades configured to engage the toy vehicle 106, and the paddles are configured to move to drive movement of the toy vehicle 106 into the opening 108. Additionally, the head 102 defines a passageway 112 connected to the opening 108, and the passageway 112 is configured to direct the toy vehicle 106 from the opening 108 into an interior 114 of the main body 104. The main body 104 may then hold and store the toy vehicle 106 within the interior 114.

For example, the interior 114 of the toy vehicle carrier 100 may facilitate ease of transportation of the toy vehicle 106 via the toy vehicle carrier 100. Indeed, the interior 114 may be sufficiently large enough to hold multiple toy vehicles 106 and enable simultaneous transportation of each toy vehicle 106 within the interior 114. Additionally or alternatively, the main body 104 includes a receptacle 116 configured to store and hold the toy vehicle 106 without having the toy vehicle 106 pass through the opening 108. To this end, the receptacle 116 may not be connected to the passageway 112 and, instead, may be directly accessible by a user to enable positioning of the toy vehicle 106 therein. The toy vehicle carrier 100 may be able to transport each toy vehicle 106 stored in the interior 114 and in the receptacle 116 to facilitate transportation of multiple toy vehicles 106.

The toy vehicle carrier 100 may also be configured to expel or discharge the toy vehicle 106. As an example, the head 102 includes a track 118 extending into the passageway 112. The track 118 is configured to receive the toy vehicle 106 and direct the toy vehicle 106 (e.g., via a gravitational force) into the passageway 112, through the opening 108, and out of the head 102. Additionally or alternatively, the main body 104 includes an outlet 120 connected to the interior 114 of the main body 104. The outlet 120 is configured to expel the toy vehicle 106 directly out of the toy vehicle carrier 100 from the interior 114. In some embodiments, the outlet 120 is large enough to expel multiple toy vehicles 106 from the interior 114, thereby facilitating access to multiple toy vehicles 106 (e.g., after the toy vehicles 106 have been transported to a desirable location) previously stored in the interior 114.

In certain embodiments, the head 102 is configured to transition between a closed configuration (e.g., an intake configuration) and an open configuration (e.g., an expulsion configuration) to selectively enable intake or expulsion of the toy vehicle 106. For instance, in the closed configuration of the head 102, the track 118 does not extend into the passageway 112, thereby blocking movement of the toy vehicle 106 along the track 118 and toward the opening 108. Additionally, the closed configuration positions the roller 110 in the passageway 112, further blocking movement of the toy vehicle 106 (e.g., via the paddles) along the passageway 112, such as from the interior 114 of the main body 104, and toward the opening 108. Thus, the closed configuration may maintain storage of the toy vehicle 106 within the toy vehicle carrier 100. In the open configuration of the head 102, the track 118 extends into the passageway 112 to enable movement of the toy vehicle 106 along the track 118 and toward the opening 108. Moreover, the roller 110 is positioned external to the passageway 112 in the open configuration of the head 102. In this manner, the toy vehicle 106 is able to move along the passageway 112 and toward the opening 108 without interference from the roller 110. In addition, the positioning of the roller 110 external to the passageway 112 may hinder the roller 110 (e.g., the paddles) from intaking any other toy vehicle 106 into the toy vehicle carrier 100.

The head 102 may be manually transitioned between the closed configuration and the open configuration (e.g., via a manually applied force). For example, the head 102 includes an actuator 122. Actuation of the actuator 122 may move the roller 110 out of the passageway 112 and move the track 118 to extend into the passageway 112 to transition the head 102 to the open configuration. Additionally or alternatively, actuation of the actuator 122 may move the roller 110 into the passageway 112 and move the track 118 out of the passageway 112 to transition the head 102 to the closed configuration. Thus, the user may use the actuator 122 to selectively place the toy vehicle carrier 100 in either the open configuration or the closed configuration. In certain embodiments, the actuator 122 is a lever that may be actuated via rotation. In additional or alternative embodiments, the actuator 122 may be a knob, a button, a dial, or any other suitable feature configured to transition the head 102 between the closed configuration and the open configuration. Furthermore, although the present disclosure primarily discusses usage of a single actuator 122 to transition the head 102 between the closed configuration and the open configuration (e.g., a single actuator 122 configured to cause movement of the roller 110 and of the track 118), multiple actuators 122 may be utilized in other embodiments to transition the head 102 between the closed configuration and the open configuration (e.g., separate actuators 122 to cause movement of the roller 110 and of the track 118).

Figure 1B:
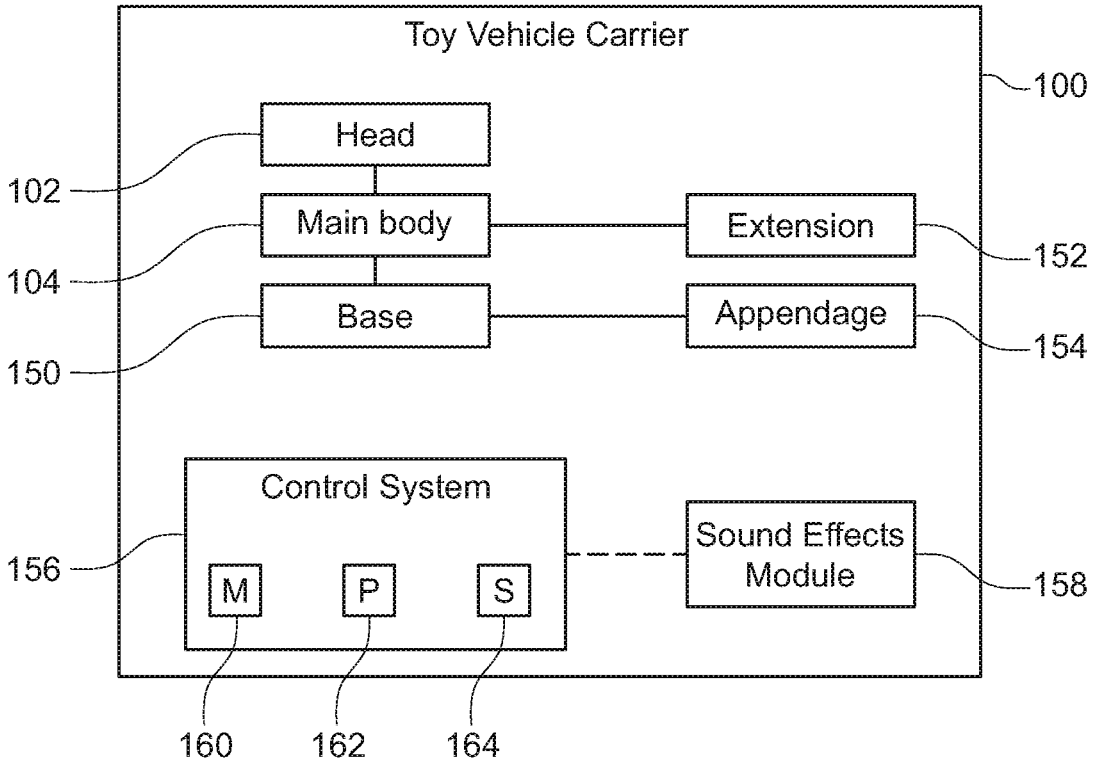

FIG. 1B illustrates another schematic diagram of the toy vehicle carrier 100 having the head 102 and the main body 104 coupled to one another. The toy vehicle carrier 100 additionally includes a base 150 coupled to the main body 104. The main body 104, as well as the head 102 coupled to the main body 104, is configured to rotate about the base 150 to transition the toy vehicle carrier 100 between a first configuration and a second configuration. For example, rotation of the main body 104 away from the base 150 (e.g., to increase an angle between the main body 104 and the base 150) transitions the toy vehicle carrier 100 toward the second configuration, and rotation of the main body 104 toward the base 150 (e.g., the reduce the angle between the main body 104 and the base 150) transitions the toy vehicle carrier 100 toward the first configuration. In additional or alternative embodiments, the main body 104 may move (e.g., translate) in any other suitable manner relative to the base 150 to transition the toy vehicle carrier 100 between the first configuration and the second configuration.

The toy vehicle carrier 100 may have different appearances in the first configuration and in the second configuration. Additionally, the toy vehicle carrier 100 may have different functionalities in the different configurations. For example, the head 102, the main body 104, and the base 150 may generally align along a plane in the first configuration. Thus, in the first configuration, each of the head 102, the main body 104, and the base 150 may engage a surface and enable the head 102 to capture a toy vehicle 106 positioned on the surface. As an example, the head 102, the main body 104, and/or the base 150 are coupled to wheels to facilitate movement along the surface in the first configuration and facilitate capture of the toy vehicle 106 via the head 102. In the second configuration, the head 102 and the main body 104 may no longer engage the surface. Thus, the head 102 may not be able to capture the toy vehicle 106 positioned on the surface in the second configuration. Instead, as further discussed herein, the second configuration may facilitate expulsion of a toy vehicle 106 (e.g., via the head 102, via the main body 104), such as onto the surface with which the base 150 engages.

The toy vehicle carrier 100 includes an extension 152 configured to facilitate transition of the toy vehicle carrier 100 between the first configuration and the second configuration. For example, the extension 152 is coupled to the main body 104 and is configured to rotate about the main body 104. The extension 152 may be used as leverage to facilitate rotation of the main body 104 away from the base 150. In other words, the extension 152 may function as a lever that enables a user to provide a sufficient amount of force/torque (e.g., by pushing against the extension 152) to drive rotation of the main body 104 away from the base 150.

The extension 152 may also be used to maintain the toy vehicle carrier 100 in the first configuration and/or in the second configuration. By way of example, the extension 152 transitions between an extended configuration, in which the extension 152 generally extends away from the main body 104 (e.g., a tip of the extension 152 is a first threshold distance, such as within 1-5 centimeters (cm), away from the main body 104), and a compact configuration, in which the extension 152 generally extends alongside the main body 104 (e.g., the tip of the extension 152 is within a second threshold distance, such as over 10-20 cm, from the main body 104). The extended configuration of the extension 152 blocks rotation of the main body 104 toward the base 150, and the compact configuration of the extension 152 blocks rotation of the main body 104 away from the base 150. In this way, in order to transition the toy vehicle carrier 100 to the second configuration, the extension 152 may initially be transitioned to the extended configuration, and the extension 152 in the extended configuration may then be used as leverage to rotate the main body 104 away from the base 150. In order to transition the toy vehicle carrier 100 to the first configuration, the extension 152 may initially be transitioned to the compact configuration to enable the main body 104 to rotate toward the base 150 (e.g., via a gravitational force and/or a manually applied force). Thus, the extension 152 may be used to selectively place the toy vehicle carrier 100 in a desirable configuration. Although the disclosure primarily discusses rotation of the extension 152 to transition between the compact configuration and the extended configuration, the extension 152 may be moved in any other suitable manner, such as in a linear direction, to facilitate transition of the toy vehicle carrier 100 between the first configuration and the second configuration.

The toy vehicle carrier 100 also includes an appendage 154 coupled to the base 150. The appendage 154 is configured to move, such as rotate, relative to the base 150. In some embodiments, movement of the base 150 along a surface may cause movement of the appendage 154 relative to the base 150. For example, a wheel having a protrusion is coupled to the base 150. The wheel is configured to rotate about an axis to drive or facilitate movement of the base 150 (e.g., and a remainder of the toy vehicle carrier 100) along a surface. Additionally, rotation of the wheel causes the protrusion to revolve around the axis and movably engage the appendage 154, thereby driving movement of the appendage 154 relative to the base 150. That is, movement of the protrusion via rotation of the wheel causes the protrusion to adjust engagement with and disengagement from the appendage 154. By way of example, engagement of the protrusion against the appendage 154 causes movement of the appendage 154 in a first direction, and disengagement of the protrusion from the appendage 154 causes movement of the appendage 154 in a second direction (e.g., via a gravitational force). Thus, rotation of the wheel causes corresponding movement of the appendage 154. For instance, movement of the appendage 154, as caused by movement of the base 150 (e.g., the wheel) along a surface, may provide an appearance that the appendage 154 is driving movement of the toy vehicle carrier 100, such as to emulate gait or walking movements.

The toy vehicle carrier 100 further includes a control system 156 and a sound effects module 158 communicatively coupled to one another. The sound effects module 158 is configured to output various sound effects, and the control system 156 is configured to cause the sound effects module 158 to output the sound effects. The control system 156 includes a memory 160 and a processor 162 (e.g., processing circuitry). The memory 160 (e.g., magnetic hard disk drive, solid state hard drive, semiconductor storage device, random access memory (RAM), read only memory (ROM), erasable programmable read only memory (EPROM), application specific integrated circuit (ASIC)) includes any suitable memory, such as volatile or non-volatile memory, configured to store data/information, such as software or logic. For example, the memory 160 includes transitory or non-transitory computer-readable media that stores instructions executable by the processor 162. The processor 162 (e.g., a microprocessor, a digital signal processor, a baseband signal processor) is configured to execute the instructions stored on the memory 160 to perform various operations, such as to cause the sound effects module 158 to output sound effects.

In certain embodiments, the control system 156 (e.g., the processor 162) is configured to cause the sound effects module 158 to output sound effects based on the configuration of the toy vehicle carrier 100. By way of example, the control system 156 is configured to cause the sound effects module 158 to output first sound effects while the toy vehicle carrier 100 is in the first configuration (e.g., while the toy vehicle carrier 100 is moving along a surface in the first configuration), and the control system 156 is configured to cause the sound effects module 158 to output second sound effects while the toy vehicle carrier 100 is in the second configuration (e.g., while the toy vehicle carrier 100 is moving along a surface in the second configuration). Providing different sound effects in the different configurations of the toy vehicle carrier 100 may further enhance entertainment provided by the toy vehicle carrier 100. For instance, the sound effects may correspond to the respective appearance of the toy vehicle carrier 100 in the different configurations, thereby providing a more realistic presentation of the toy vehicle carrier 100.

To this end, the control system 156 includes a sensor or switch 164, which may be operable to cause the processor 162 to output a particular control signal to cause the sound effects module 158 to output corresponding sound effects. That is, in the first configuration of the toy vehicle carrier 100, the sensor/switch 164 may cause the processor 162 to output a first signal that causes the sound effects module 158 to output the first sound effects. In the second configuration of the toy vehicle carrier 100, the sensor/switch 164 may cause the processor 162 to output a second signal that causes the sound effects module 158 to output the second sound effects. For instance, the different configurations of the toy vehicle carrier 100 may also adjust a configuration or position of the sensor/switch 164 to cause the sensor/switch 164 to change the operation of the processor 162.

In additional or alternative embodiments, the control system 156 is configured to cause the sound effects module 158 to output additional sound effects. As an example, the control system 156 is configured to cause the sound effects module 158 to output different sound effects in the different configurations of the head 102 and/or of the extension 152. As another example, the control system 156 is configured to cause the sound effects module 158 to output a sound effect based on movement of the toy vehicle 106 with respect to the toy vehicle carrier 100, such as capture of the toy vehicle 106 at the head 102, expulsion of the toy vehicle 106 from the head 102, expulsion of the toy vehicle 106 from the main body 104, movement of the toy vehicle 106 through the main body 104, and so forth. As a further example, the control system 156 is configured to cause the sound effects module 158 to output a sound effect during transition of the toy vehicle carrier 100, or of any component of the toy vehicle carrier 100, between different configurations. Output of such sound effects may further enhance realistic and entertaining portrayal of the toy vehicle carrier 100.

Figure 2A:
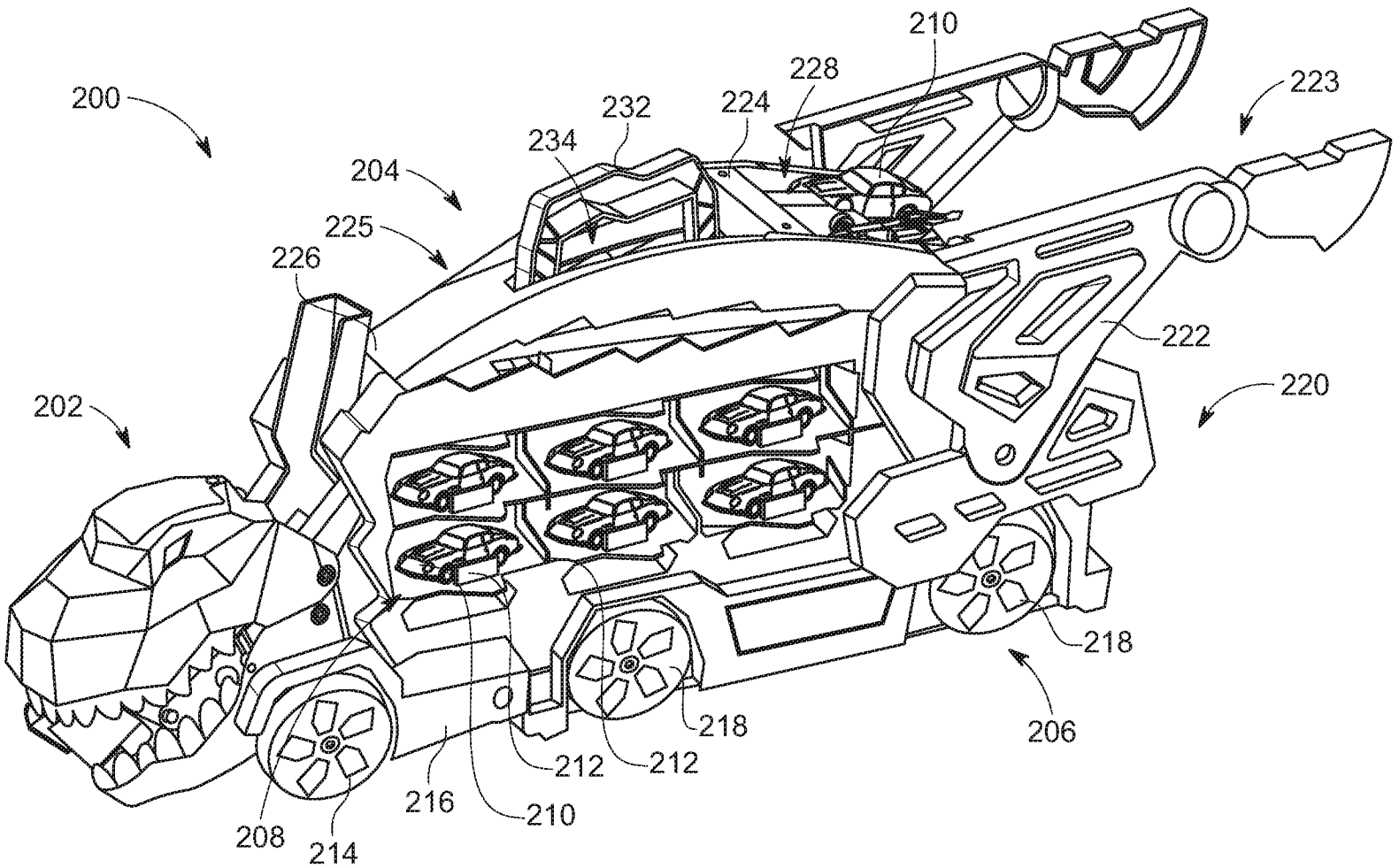
FIGS. 2*a*-2*c* illustrate perspective side views of a toy vehicle carrier in a first configuration in accordance with an example embodiment of the present application.

FIG. 2*a* illustrates a perspective view of an embodiment of a toy vehicle carrier 200 having a head 202 and a main body 204 coupled to one another, as well as a base 206 coupled to the main body 204. In the illustrated embodiment, the main body 204 includes multiple receptacles 208, each of which is configured to hold a respective toy vehicle 210. For example, each receptacle 208 includes walls 212 that cooperatively define a space in which the toy vehicle 210 may be positioned, and the walls 212 surround the toy vehicle 210 positioned within the space to block movement of the toy vehicle 210 out of the receptacle 208, thereby retaining the toy vehicle 210 within the receptacle 208, such as during movement of the toy vehicle carrier 200. As such, the receptacles 208 may enable transportation of multiple toy vehicles 210 via the toy vehicle carrier 200. However, each receptacle 208 is exposed to an exterior environment surrounding the toy vehicle carrier 200. Thus, each receptacle 208 is readily accessible by a user to enable the user to insert the toy vehicle 210 into and/or remove the toy vehicle 210 from one of the receptacles 208. For example, a user may selectively remove a first toy vehicle 210 from a first receptacle 208, while positioning a second toy vehicle 210 in a second receptacle 208 to change the toy vehicle 210 being held by the toy vehicle carrier 200.

Additionally, the toy vehicle carrier 200 includes multiple wheels to facilitate movement of the toy vehicle carrier 200 along a surface (e.g., a floor, a table). For example, the toy vehicle carrier 200 includes main body wheels 214 attached to the main body 204 via respective limbs or arms 216, as well as base wheels 218 attached to the base 206. The main body wheels 214 and the base wheels 218 are configured to rotate to facilitate movement of the toy vehicle carrier 200 along the surface. In the illustrated embodiment, the arms 216 extend along the head 202 and the main body 204 to extend the main body wheels 214 alongside the head 202.

Referring to FIG. 2*a*, the toy vehicle carrier 200 is in a first configuration 220 (e.g., a folded configuration, a prone configuration) in the illustrated embodiment. In the first configuration 220, the head 202, the main body 204, and the base 206 may generally extend along one another about a common axis or plane. For this reason, in the first configuration 220, each of the head 202, the main body 204, and the base 206 may engage or be adjacent to the surface. As an example, each of the main body wheels 214 and the base wheels 218 may engage the surface and rotate about the surface in the first configuration 220 to drive or facilitate movement of the toy vehicle carrier 200 along the surface.

Additionally, the toy vehicle carrier 200 includes appendages 222 coupled to the base 206 and configured to rotate relative to the base 206. The appendages 222 are in a retracted configuration 223 in the first configuration 220 of the toy vehicle carrier 200. In the retracted configuration 223, the appendages 222 generally extend away from the base wheels 218 and from the surface with which the base wheels 218 may engage. For example, as discussed herein, a base wheel 218 includes protrusions that may movably engage the appendages 222 extending alongside or adjacent to the base wheels 218. However, the appendages 222 are offset from the base wheels 218 and clear of the protrusions in the retracted configuration 223. Thus, movement of the appendages 222 relative to the base 206 via the protrusions is blocked in the first configuration 220 of the toy vehicle carrier 200.

The toy vehicle carrier 200 also includes an extension 224 coupled to the main body 204. In the first configuration 220 of the toy vehicle carrier 200, the extension 224 generally extends along the main body 204 in a compact configuration 225. For example, a tip 226 of the extension 224 may be positioned adjacent to or in engagement with the main body 204 in the compact configuration 225. The compact configuration 225 of the extension 224 may block rotation of the main body 204 away from the base 206 (e.g., via a stop or linkage system). Thus, the compact configuration 225 of the extension 224 may maintain the toy vehicle carrier 200 in the first configuration 220. As discussed herein, the extension 224 may be rotated relative to the main body 204 to transition the extension 224 out of the compact configuration 225 and enable rotation of the main body 204 away from the base 206. For instance, rotation of the extension 224 may enable transition of the toy vehicle carrier 200 from the first configuration 220 to a second configuration. The extension 224 also includes additional receptacles 228, which may be configured to receive and hold additional toy vehicles 210. In this manner, the extension 224 also increases a carrying capacity of the toy vehicle carrier 200 to hold toy vehicles 210.

The toy vehicle carrier 200 further includes a handle or grip 232 extending from the main body 204. The handle 232 may help a user move the toy vehicle carrier 200. For example, the user may grip the handle 232 and impart a force onto the handle 232 to drive movement of the toy vehicle carrier 200 along a surface. The handle 232 may also help the user carry the toy vehicle carrier 200 more easily. To accommodate positioning of the handle 232, the extension 224 includes an opening 234 through which the handle 232 may extend while the extension 224 is in the compact configuration 225.

Figure 2B:
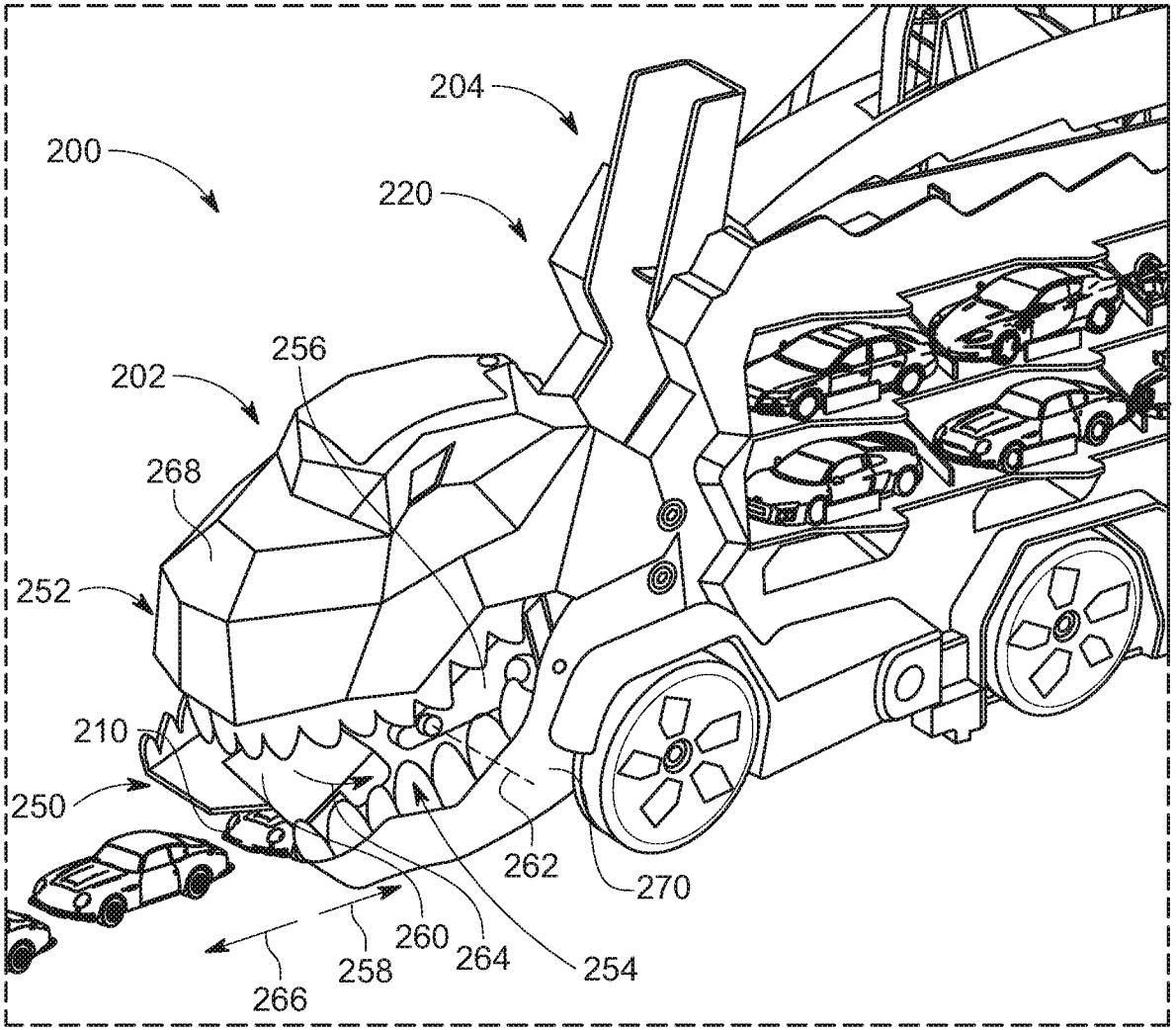

FIG. 2*b* illustrates a perspective view of the toy vehicle carrier 200 in the first configuration 220 in which the head 202 is positioned adjacent to a surface on which toy vehicles 210 may be placed. Thus, the head 202 may be able to capture the toy vehicles 210 in the first configuration 220 of the toy vehicle carrier 200. For example, the head 202 includes an opening 250 configured to receive the toy vehicle 210. The head 202 may be in a closed configuration 252 while the toy vehicle carrier 200 is in the first configuration 220, and the opening 250 is connected to a passageway 254 extending to the main body 204 in the closed configuration 252. Thus, the toy vehicle 210 may move from the opening 250 toward the main body 204 via the passageway 254 in the closed configuration 252. As such, the head 202 enables intake of toy vehicles 210 for storage in the main body 204.

In addition, the head 202 includes a roller 256 positioned in the passageway 254 (e.g., adjacent to the opening 250) in the closed configuration 252 of the head 202. The roller 256 is configured to drive movement of the toy vehicle 210 in an intake direction 258 into the head 202 (e.g., toward the main body 204). By way of example, the roller 256 includes paddles or blades 260 configured to move (e.g., rotate, revolve) about an axis 262 in a rotational direction 264 while the toy vehicle carrier 200 moves in a travel direction 266, opposite the intake direction 258. By way of example, movement of the toy vehicle carrier 200 in the travel direction 266 may drive movement of a linkage system (e.g., a gear) connected to the paddles 260 to cause movement of the paddles 260 in the rotational direction 264. The paddles 260 are configured to engage a toy vehicle 210 extending into the opening 250, and rotation of the paddles 260 in the rotational direction 264 drives movement of the toy vehicle 210 along the passageway 254 and toward the main body 204.

The illustrated head 202 includes a cover 268 and a head base 270 coupled to one another. The cover 268 and the head base 270 generally extend crosswise to one another to define the opening 250 and the passageway 254 between the cover 268 and the head base 270. The cover 268 and the head base 270 are configured to rotate relative to one another to transition the head 202 between the closed configuration 252 and an open configuration. For example, the cover 268 and the head base 270 may be moved toward one another to transition the head 202 to the closed configuration 252. For this reason, the opening 250 and the passageway 254 cooperatively defined by the cover 268 and the head base 270 are relatively small in the closed configuration 252. In some embodiments, in the closed configuration 252 of the head 202, movement of the toy vehicle carrier 200 (e.g., in the travel direction 266) may drive some movement of the cover 268 relative to the head base 270. For example, in the closed configuration 252, the paddles 260 may movably engage the cover 268. That is, rotation of the paddles 260 may drive some movement of the cover 268 relative to the head base 270. For example, the paddles 260 may alternate between engagement with and disengagement from the cover 268. Engagement of the rotating paddles 260 with the cover 268 may drive movement of the cover 268 away from the head base 270, whereas disengagement of the paddles 260 from the cover 268 may cause movement of the cover 268 toward the head base 270 (e.g., via a gravitational force). In this way, the cover 268 may alternate between moving toward and away from the head base 270. Such movement of the cover 268 relative to the head base 270 may provide a realistic and entertaining appearance of the head 202. For instance, the cover 268 and the head base 270 may form a jaw appearance, and movement of the cover 268 relative to the head base 270 may provide an appearance of an eating or chomping movement by the head 202, such as to portray the head 202 is ingesting the toy vehicle 210.

Figure 2C:
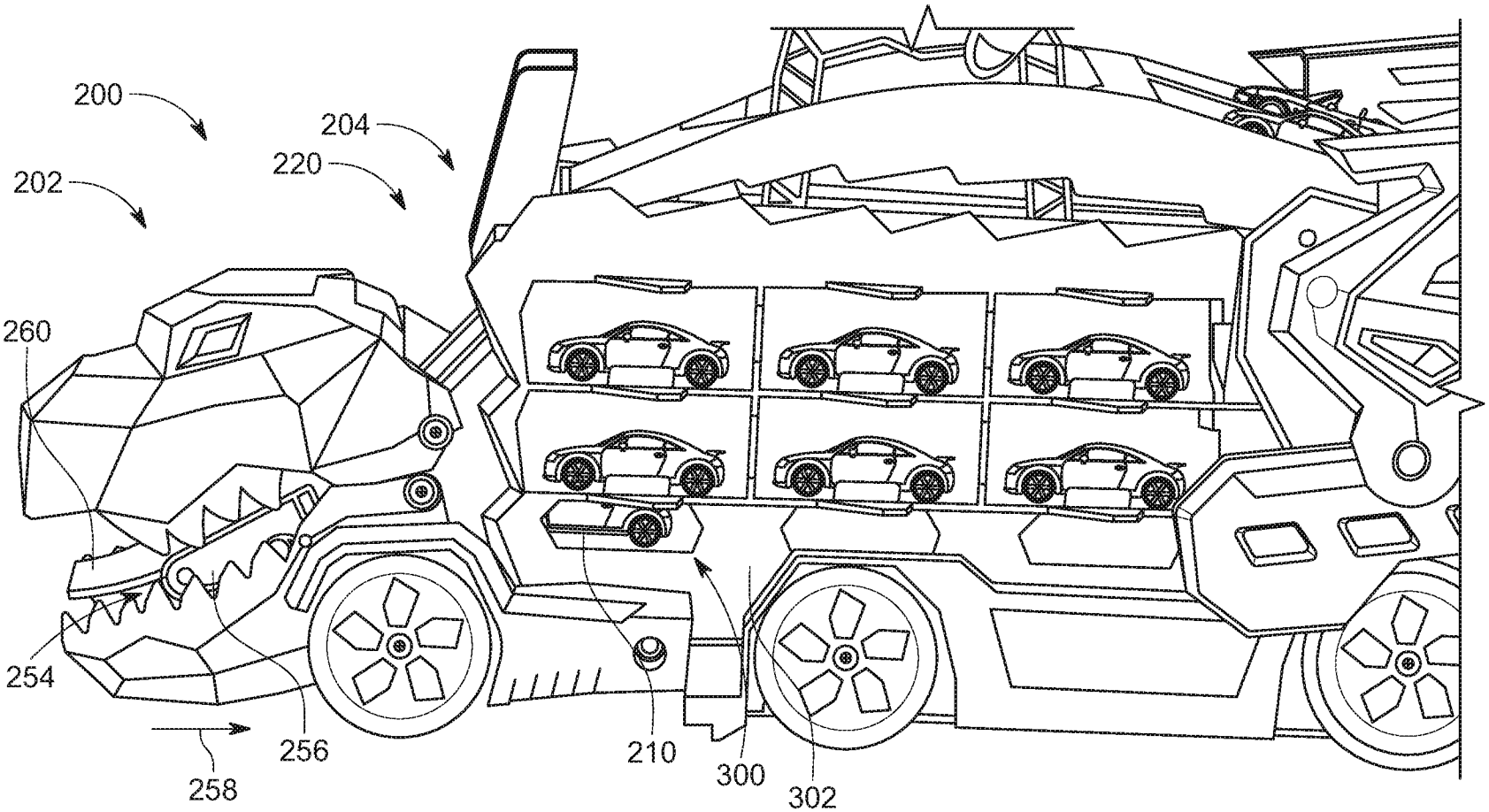

FIG. 2*c* illustrates a side perspective view of the toy vehicle carrier 200 in its first configuration 220. In the illustrated embodiment, a toy vehicle 210 is positioned within an interior 300 of a chassis 302 of the main body 204. For example, the passageway 254 of the head 202 is connected to the interior 300 of the chassis 302. Movement of the toy vehicle 210 along the intake direction 258, as driven via movement of the paddles 260 of the roller 256, may cause the toy vehicle 210 to move through the passageway 254 and into the interior 300. The toy vehicle carrier 200 may store and hold the toy vehicle 210 within the interior 300. The interior 300 may be sufficiently large to hold multiple toy vehicles 210. Thus, the interior 300 may enable the head 202 to sequentially and successively intake multiple toy vehicles 210 (e.g., without having to remove toy vehicles 210 stored in the interior 300 between intake of additional toy vehicles 210).

Figure 3A:
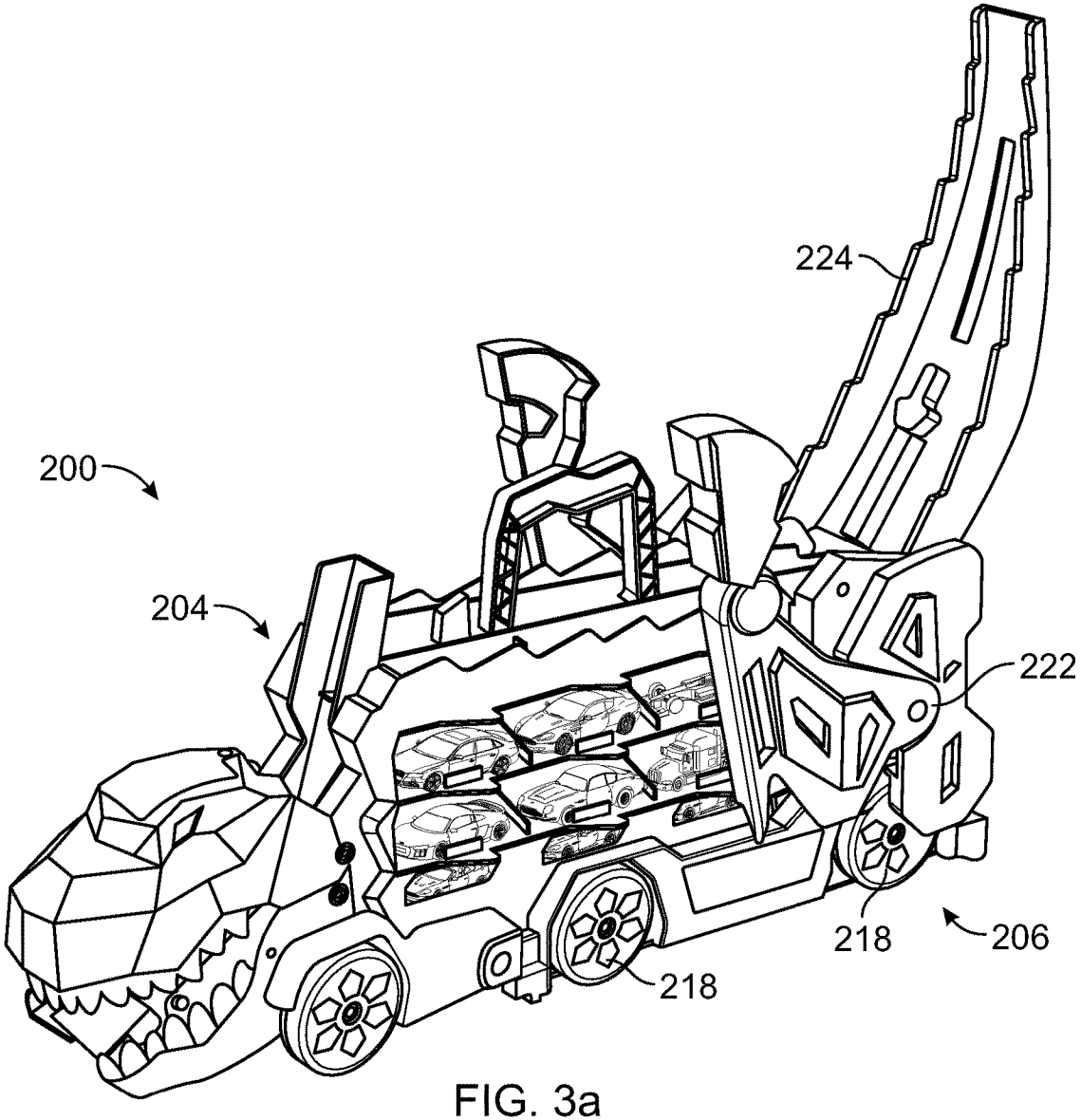
FIGS. 3*a* and 3*b* illustrate perspective side views of the toy vehicle carrier of FIGS. 2*a*-2*c* transitioning between the first configuration and a second configuration.

FIG. 3*a* illustrates the toy vehicle carrier 200 transitioning from the first configuration 220 toward a second configuration. For example, the extension 224 may be rotated away from the main body 204 to transition the extension 224 out of the compact configuration 225 and enable the main body 204 to move away from the base 206. Rotation of the extension 224 may also drive movement of the appendages 222. By way of example, rotation of the extension 224 may drive movement of the appendages 222 toward the base wheels 218 (e.g., via a linkage system).

Figure 3B:
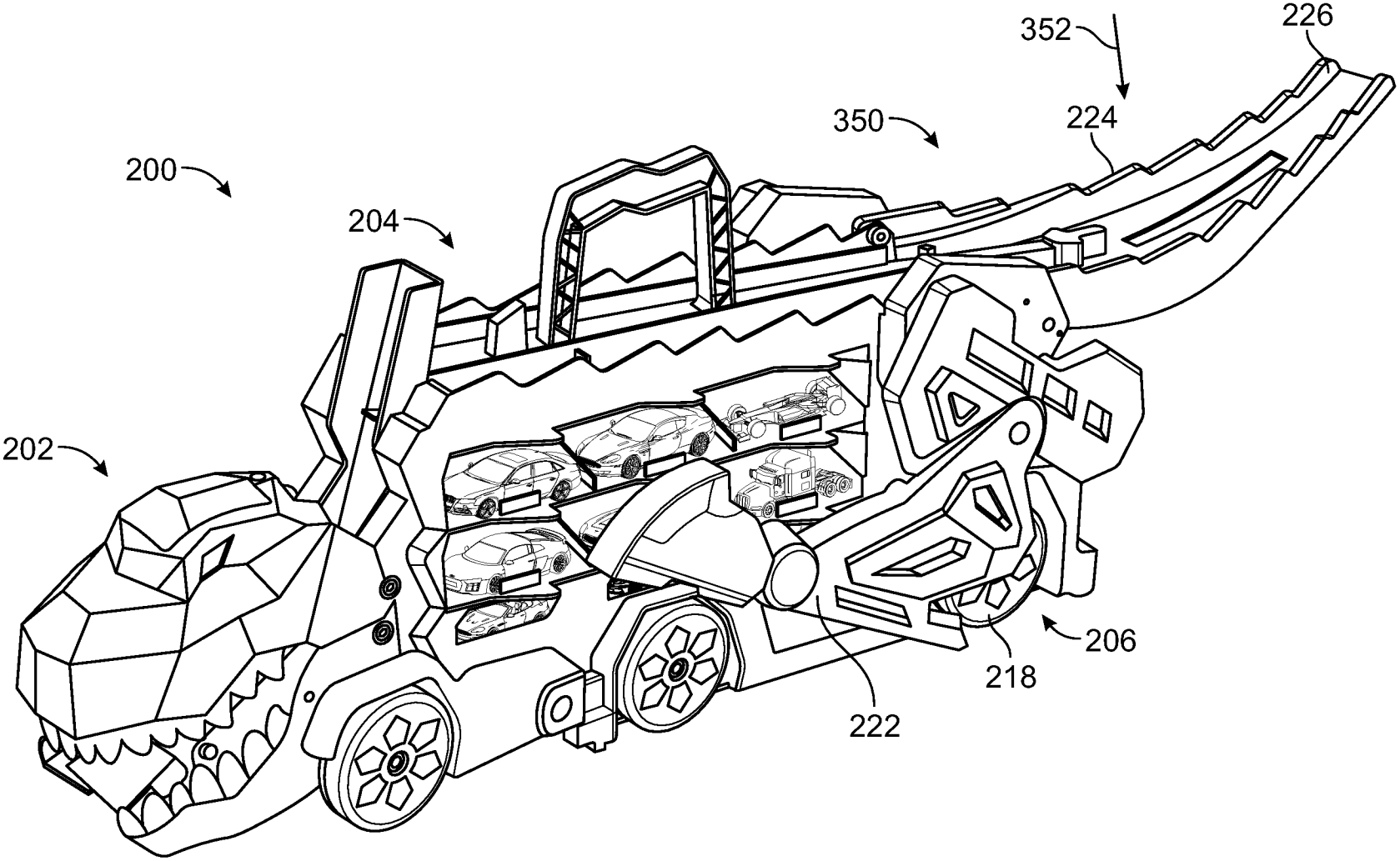

FIG. 3*b* illustrates the toy vehicle carrier 200 transitioning from the first configuration 220 toward a second configuration. In the illustrated embodiment, the extension 224 is in an extended configuration 350 in which the extension 224 generally extends away from the main body 204. Additionally, the appendages 222 extend at least partially across a respective one of the base wheels 218. However, the head 202, the main body 204, and the base 206 remain in general extension along a common axis or plane. The extension 224 may be used as leverage to move the main body 204, as well as the head 202 coupled to the main body 204, away from the base 206. For example, the toy vehicle carrier 200 may include a stop or wall that blocks further rotational movement of the extension 224 away from the main body 204. Thus, a force imparted onto the extension 224 (e.g., onto the tip 226) in a direction 352 crosswise to the extension 224 (e.g., toward a surface on which the toy vehicle carrier 200 is positioned) may cause the extension 224 to drive movement of the main body 204 away from the base 206, thereby transitioning the toy vehicle carrier 200 to the second configuration.

Figure 4:
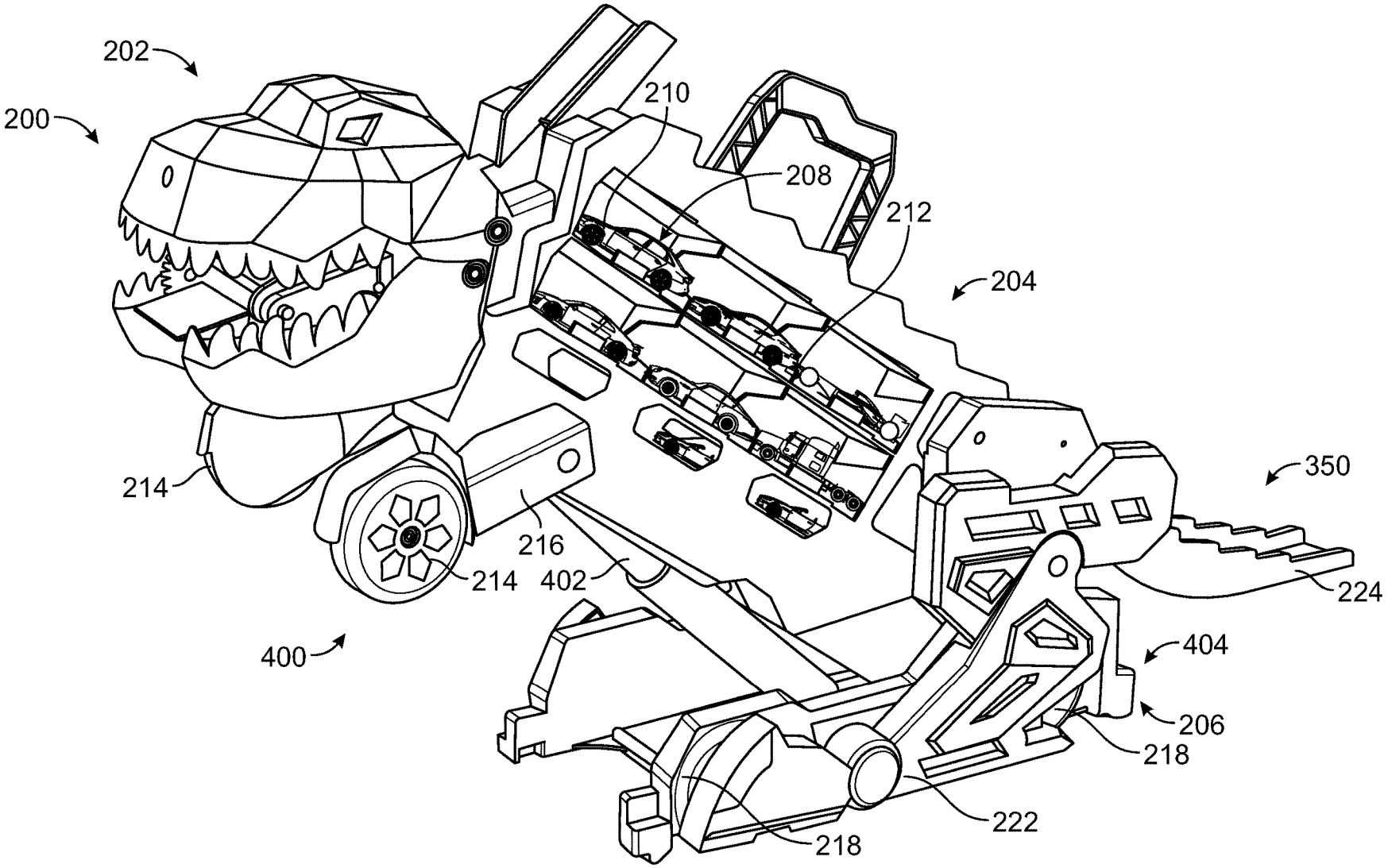
FIG. 4 illustrates a perspective side view of the toy vehicle carrier of FIGS. 2*a*-2*c* in the second configuration.

FIG. 4 illustrates the toy vehicle carrier 200 in a second configuration 400 (e.g., an unfolded configuration, a standing configuration). In the second configuration 400, the base wheels 218 may remain in engagement with a surface on which the toy vehicle carrier 200 is positioned, but the main body 204 extends away from the base 206 to offset the main body wheels 214 from the surface. Indeed, the main body 204 may be oriented relatively more upright in the second configuration 400 than in the first configuration 220. For this reason, a gravitational force may urge the main body 204 to move toward the base 206 and transition the toy vehicle carrier 200 toward the first configuration 220. However, the extended configuration 350 of the extension 224 in the second configuration 400 of the toy vehicle carrier 200 may block or limit rotation of the main body 204 toward the base 206, thereby maintaining the toy vehicle carrier 200 in the second configuration 400. In some embodiments, the toy vehicle carrier 200 also includes a piston 402 connected to the base 206 and to the main body 204 (e.g., to the chassis 302). The piston 402 may support the orientation of the main body 204 relative to the base 206 and further maintain the toy vehicle carrier 200 in the second configuration 400. For instance, the piston 402 (e.g., a pneumatic piston, a hydraulic piston) may impart a resistive force to resist movement of, and therefore support the orientation of, the main body 204 relative to the base 206.

In the second configuration 400, the appendages 222 extend alongside the base wheels 218 in a deployed configuration 404 of the appendages 222. As such, the protrusions of the base wheels 218 may movably engage the appendages 222 during movement of the toy vehicle carrier 200 to cause rotation of the appendages 222 relative to the base 206 while the appendages 222 are in the deployed configuration 404. Furthermore, in the second configuration 400, a gravitational force may urge movement of the toy vehicles 210 positioned within the receptacles 208 toward the base 206 (e.g., toward the surface with which the base 206 engages). However, the walls 212 may block movement of the toy vehicles 210 out of the receptacles 208. In other words, the walls 212 maintain positioning of the toy vehicle 210 within the receptacles 208 in the second configuration 400.

Moreover, in the illustrated second configuration 400, the arms 216 are positioned to extend the main body wheels 214 offset from the head 202. That is, the main body wheels 214 are not positioned alongside the head 202 in the second configuration 400. As an example, a gravitational force may urge movement of the arms 216 toward the base 206 and away from the head 202, thereby moving the main body wheels 214 to be offset from the head 202.

It should be noted that rotation of the extension 224 toward the main body 204 may facilitate transition of the toy vehicle carrier 200 from the second configuration 400 toward the first configuration 220. For example, rotation of the extension 224 toward the main body 204 to transition the extension 224 to the compact configuration 225 may enable rotation of the main body 204 toward the base 206. After the extension 224 has been transitioned to the compact configuration 225, a gravitational force and/or a manually applied force may overcome the resistive force imparted by the piston 402 to drive rotation of the main body 204 toward the base 206 to transition the toy vehicle carrier 200 to the first configuration 220. In other words, the gravitational force and/or the manually applied force causes movement of the piston 402 to move the main body 204 toward the base 206. However, the resistive force imparted by the piston 402 may slow the rotation of the main body 204 toward the base 206. For example, the piston 402 may ease movement of the main body 204 toward the base 206 to avoid an undesirable collision between the toy vehicle carrier 200 (e.g., the head 202, the main body 204) and the surface on which toy vehicle carrier 200 is positioned and/or between the main body 204 and the base 206. Thus, the piston 402 may help preserve a structural integrity of the toy vehicle carrier 200.

Rotation of the extension 224 toward the main body 204 also drives movement of the appendages 222 away from the base wheels 218. Thus, sufficient rotation of the extension 224 toward the main body 204 offsets the appendages 222 from the base wheels 218. As a result, movement of the appendages 222 is no longer driven by the base wheels 218 (e.g., the protrusions).

Figure 5:
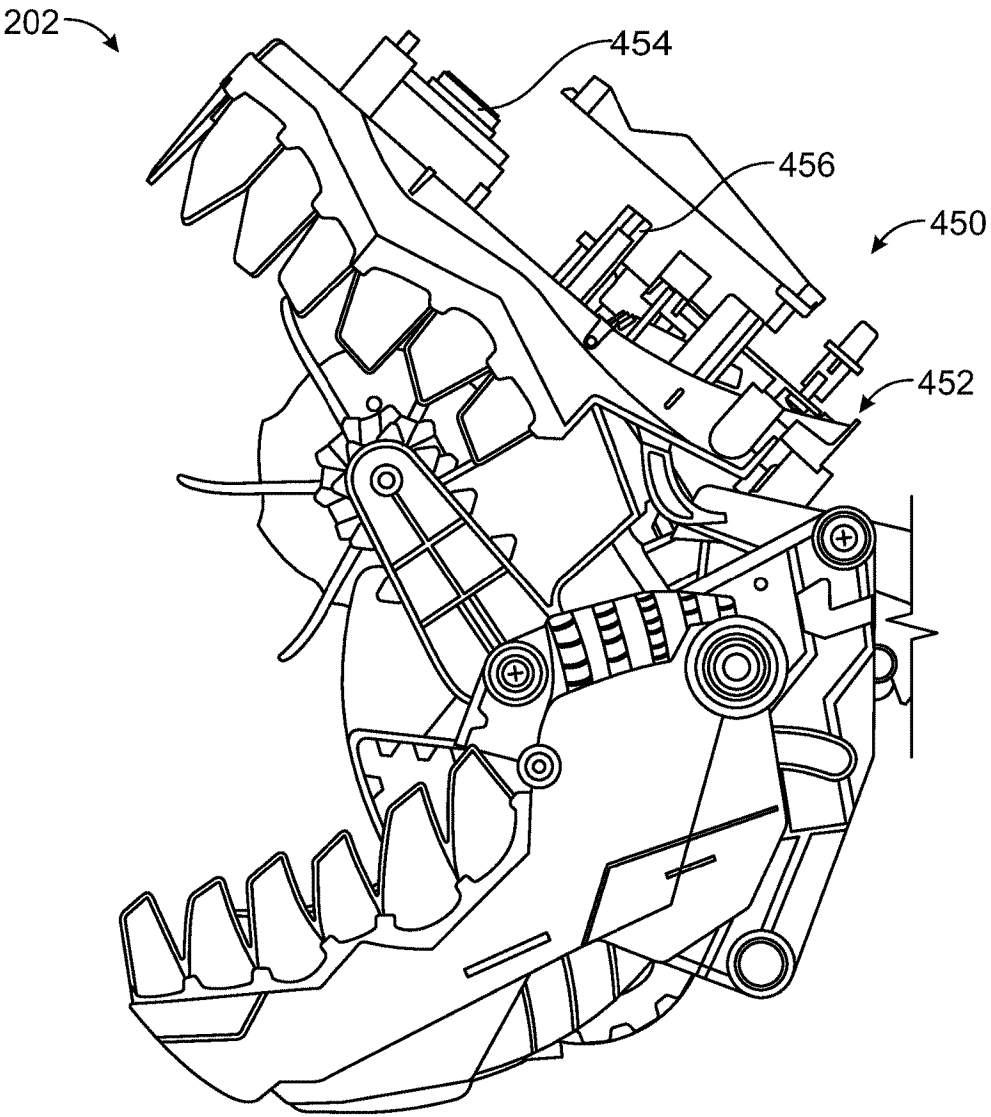
FIG. 5 illustrates a side view of a head of the toy vehicle carrier of FIGS. 2*a*-2*c;*

FIG. 5 illustrates a side view of the head 202 of the toy vehicle carrier 200. The cover 268 is not shown in FIG. 5 for visualization purposes of components positioned within an interior 450 of the cover 268. As an example, the toy vehicle carrier 200 includes a control system 452 (e.g., a memory, a processor, a sensor, a switch, circuitry), a sound effects module 454 (e.g., a sound emitter, a horn), and a power source 456 positioned within the interior 450. The control system 452 is configured to cause the sound effects module 454 to output different sound effects. For example, the control system 452 is configured to cause the sound effects module 454 to output first sound effects in the first configuration 220 of the toy vehicle carrier 200, and the control system 452 is configured to cause the sound effects module 454 to output second sound effects, different from the first sound effects, in the second configuration 400 of the toy vehicle carrier 200. The control system 452 may also cause the sound effects module 454 to output additional sound effects, such as different sound effects in the closed configuration 252 and the open configuration of the head 202, different sound effects in the compact configuration 225 and the extended configuration 350 of the extension 224, sound effects during transition of any of the components of the toy vehicle carrier 200 between the respective configurations, sound effects during passing of the toy vehicle 210 through the toy vehicle carrier 200, sound effects during movement of the toy vehicle carrier 200 along a surface, and so forth. The sound effects may provide additional interactive entertainment for a user by portraying realistic or engaging sound effects.

The power source 456 supplies power to enable operation of the control system 452 and/or of the sound effects module 454. For example, the control system 452 may utilize the power supplied by the power source 456 to cause the sound effects module 454 to operate, and the sound effects module 454 may utilize the power supplied by the power source 456 to output sound effects. In some embodiments, the power source 456, such as a battery and/or a capacitor, is configured to store power. In additional or alternative embodiments, the power source 456 may be configured to harvest power (e.g., solar power, mechanical power) from a surrounding environment of the toy vehicle carrier 200 for delivery to operate the control system 452 and/or the sound effects module 454.

Although the control system 452, the sound effects module 454, and the power source 456 are described as being positioned at the head 202 in the illustrated embodiment, the control system 452, the sound effects module 454, and/or the power source 456 may be positioned at any other suitable location, such as at the main body 204 and/or at the base 206 in additional or alternative embodiments. Indeed, the control system 452, the sound effects module 454, and the power source 456 may be distributed at different locations to enable operation of the toy vehicle carrier 200 to output different sound effects. For example, multiple sound effects modules 454 may be positioned at different locations adjacent to respective components to portray sound effects being realistically generated by such components (e.g., a first sound effects module 454 configured to output chomping noises is positioned adjacent to the head 202, a second sound effects module 454 configured to output driving noises is positioned adjacent to the base wheels 218). Thus, the toy vehicle carrier 200 may appear to output sound effects in a more realistic manner.

Figure 6:
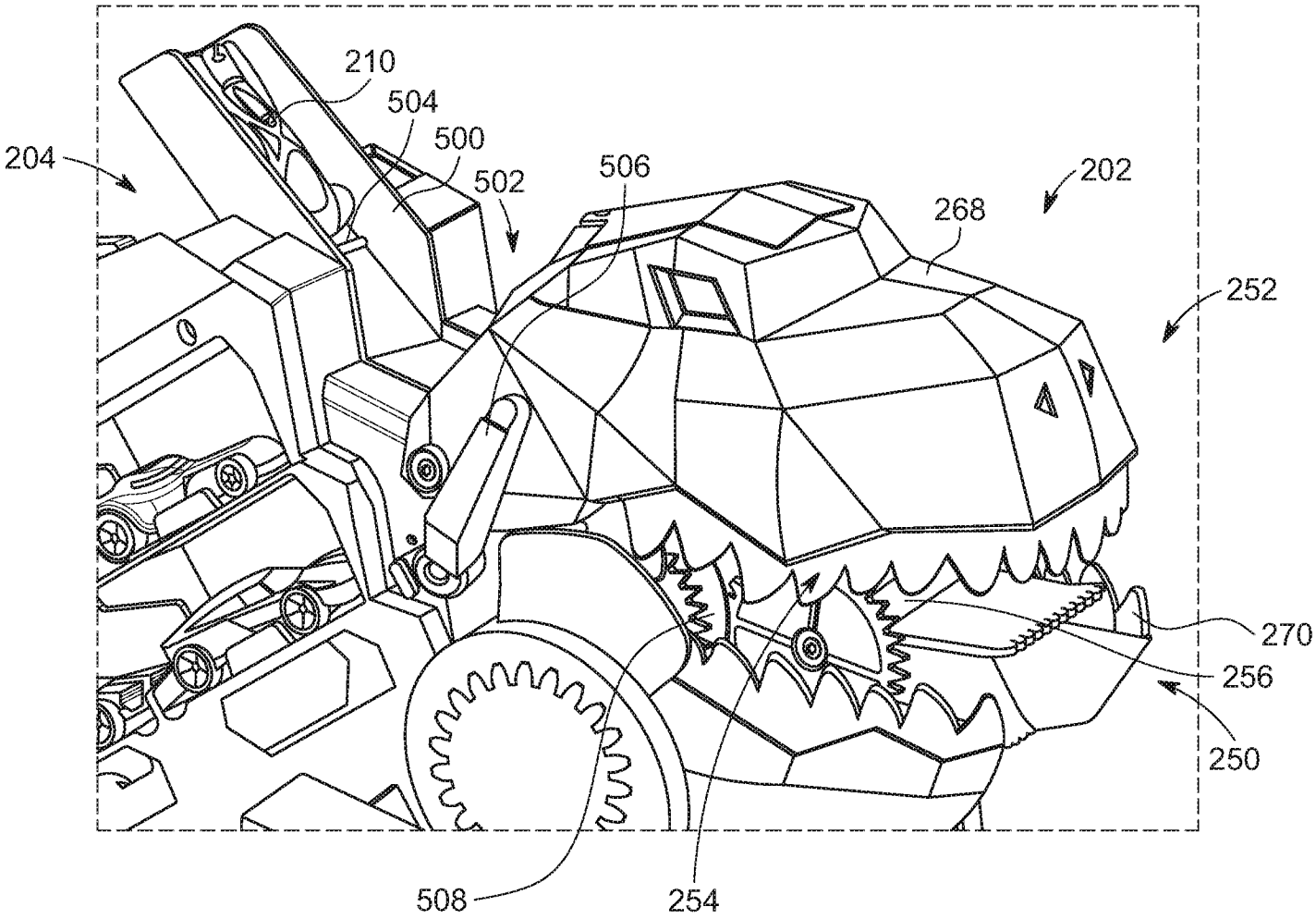
FIG. 6 illustrates a perspective side view of the head of FIG. 5 in a closed configuration.

FIG. 6 illustrates a perspective side view of the head 202 in the closed configuration 252. In the illustrated embodiment, the head 202 includes a track 500 extending toward the passageway 254 and configured to receive the toy vehicle 210. By way of example, the head 202 includes an inlet opening 502 adjacent to the main body 204, and the track 500 extends into the inlet opening 502 and toward the passageway 254. Thus, the track 500 may enable movement of the toy vehicle 210 along the track 500 and into the inlet opening 502 (e.g., as a result of a gravitational force). However, as discussed herein, the closed configuration 252 of the head 202 blocks movement of a toy vehicle 210 through the passageway 254 and out of the head 202 via the opening 250. For instance, in the closed configuration 252 of the head 202, the cover 268 and the head base 270 extend more adjacent to one another to reduce the size of the opening 250 and of the passageway 254, and the roller 256 is positioned within the passageway 254 to block movement of the toy vehicle 210 through the passageway 254 toward the opening 250. Additionally or alternatively, the head 202 includes a stop 504 that extends into the track 500 in the closed configuration 252 of the head 202, and the stop 504 abuts against the toy vehicle 210 to block movement of the toy vehicle 210 along the track 500 and into the passageway 254.

The head 202 includes an actuator 506 that may be actuated to adjust the configuration of the head 202. The illustrated actuator 506 is a lever rotatably coupled to the head base 270 and to a set of gears 508. The actuator 506 may be rotated to drive corresponding rotation of the gears 508. Rotation of the gears 508 then moves various components of the head 202 (e.g., the cover 268 and the head base 270 relative to one another) to adjust the head 202 between the closed configuration 252 and the open configuration. In additional or alternative embodiments, the actuator 506 may include any other suitable actuatable feature configured to drive movement of various components of the head 202 (e.g., via the gears 508 or another suitable linkage system) to adjust the head 202 between the closed configuration 252 and the open configuration.

Figure 7:
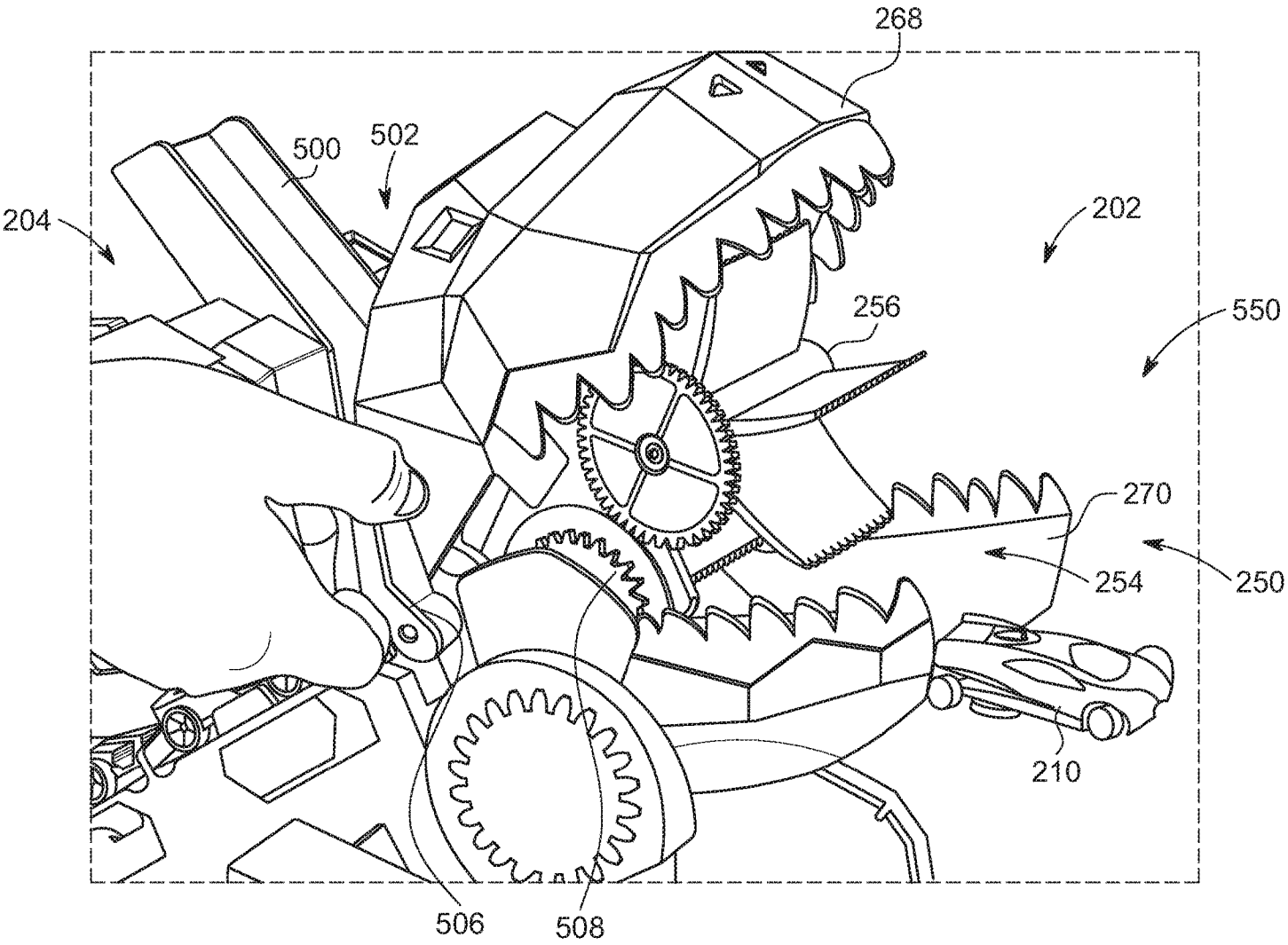
FIG. 7 illustrates a perspective side view of the head of FIG. 5 in an open configuration.

FIG. 7 illustrates a perspective side view of the head 202 in an open configuration 550. For example, the actuator 506 is actuated (e.g., via a manually applied force) to rotate toward the main body 204. Actuation of the actuator 506 drives rotation of the gears 508 to move the cover 268 and the head base 270 away from one another, thereby increasing a size of the opening 250 and of the passageway 254. Additionally, rotation of the gears 508 moves the roller 256 out of the passageway 254 and retracts the stop 504 from the track 500. Thus, in the open configuration 550 of the head 202, the toy vehicle 210 is able to move along the track 500, into the passageway 254 via the inlet opening 502, and through the opening 250 for expulsion from the head 202.

The actuator 506 may also be actuated to transition the head 202 from the open configuration 550 to the closed configuration 252. For example, rotation of the actuator 506 away from the main body 204 rotates the gears 508 to move the cover 268 and the head base 270 toward one another, to move the roller 256 into the passageway 254, and to extend the stop 504 into the track 500. Thus, a user may utilize the actuator 506 to selectively place the head 202 in either the closed configuration 252 or the open configuration 550.

Figure 8:
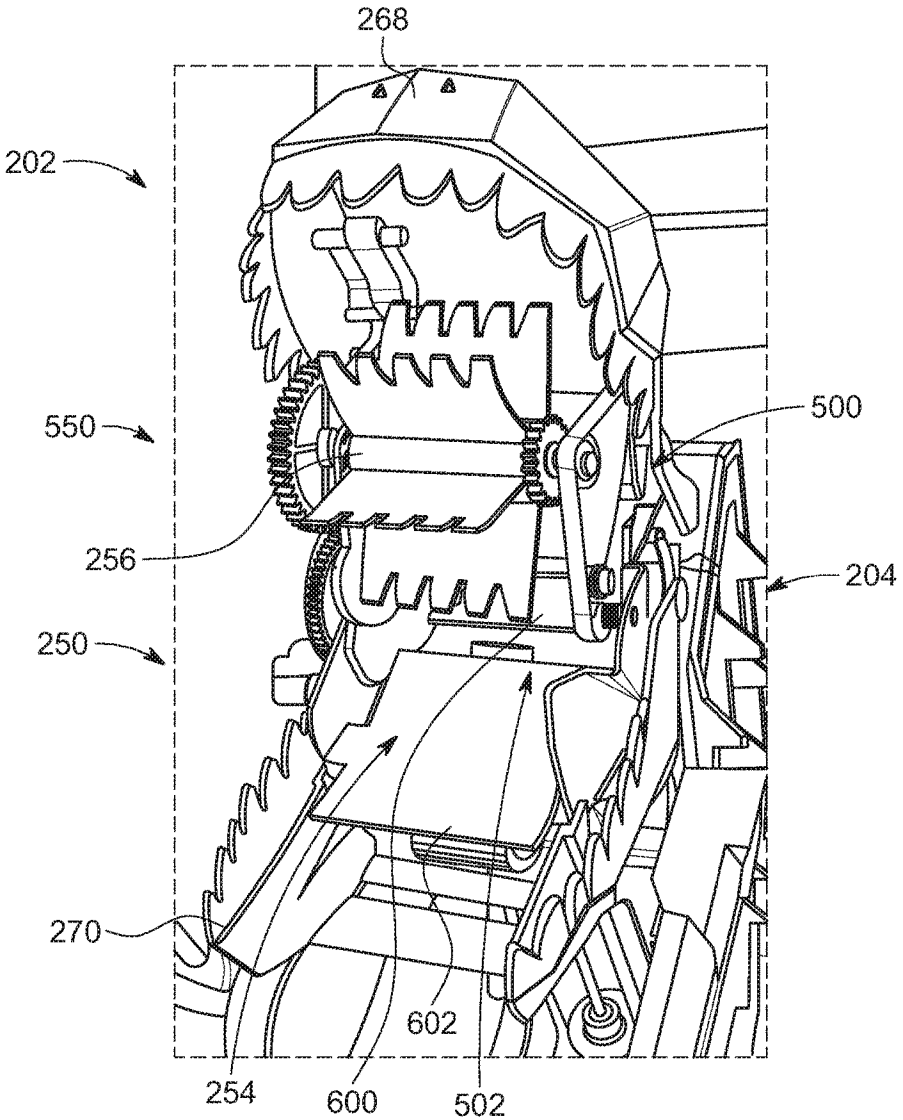
FIG. 8 illustrates a perspective front view of the head of FIG. 5 in the open configuration.

FIG. 8 illustrates a perspective front view of the head 202 in the open configuration 550 in which the cover 268 and the head base 270 are separated relatively farther away from one another and the roller 256 is moved out of the passageway 254 to enable movement of a toy vehicle 210 through the passageway 254. Additionally, in the illustrated embodiment, the track 500 is composed of multiple segments in which an end segment 600 of the track 500 extends into the inlet opening 502. In the open configuration 550 of the head 202, the end segment 600 is oriented to extend into the passageway 254. For example, the head 202 includes a plate 602 defining a portion of the passageway 254. The plate 602 enables and guides movement of the toy vehicle 210 through the passageway 254 (e.g., toward the opening 250, toward the main body 204). In the open configuration 550 of the head 202, the end segment 600 generally extends toward and is aligned with the plate 602. In this manner, the track 500 may direct a toy vehicle 210 (e.g., via a gravitational force) onto the plate 602 and into the passageway 254 via the end segment 600 in the open configuration 550 of the head 202.

Figure 9:
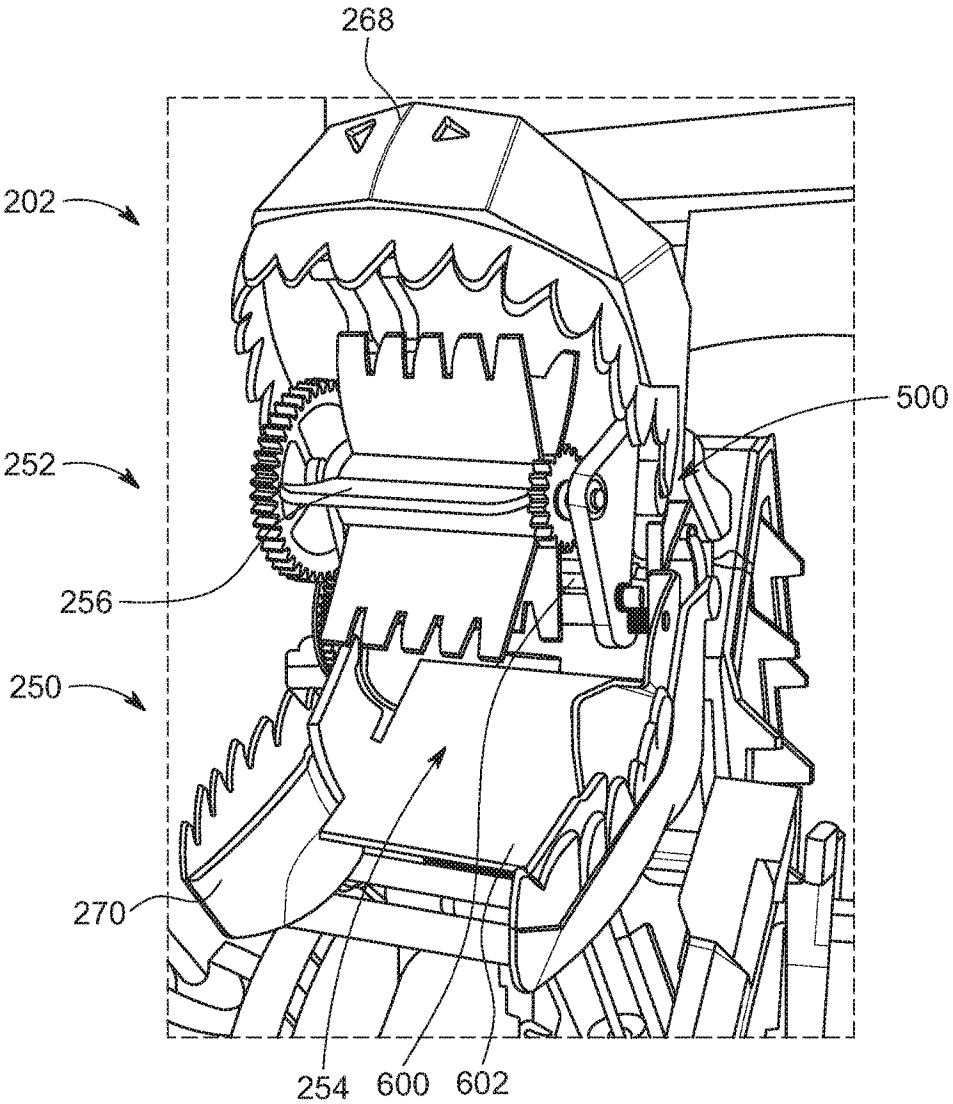
FIG. 9 illustrates a perspective front view of the head of FIG. 5 transitioning between the closed configuration and the open configuration.

FIG. 9 illustrates a perspective front view of the head 202 transitioning between the closed configuration 252 and the open configuration 550 in which the cover 268 and the head base 270 are spaced apart, such as via actuation of the actuator 506. As a result, movement of the toy vehicle 210 through the passageway 254 and toward the opening 250 via the track 500 may be at least partially blocked. By way of example, the end segment 600 of the track 500 is disposed out of the passageway 254 and/or extends away from the passageway 254. For instance, the end segment 600 may be oriented (e.g., rotated) such that the end segment 600 does not extend toward or is not generally aligned with the plate 602. In certain embodiments, actuation of the actuator 506 may rotate the end segment 600, and the end segment 600 may extend toward the roller 256 during transition of the head 202 between the closed configuration 252 and the open configuration 550. For this reason, the end segment 600 may block movement of a toy vehicle 210 from the track 500 into the passageway 254 outside of the open configuration 550 of the head 202.

Figure 10A:
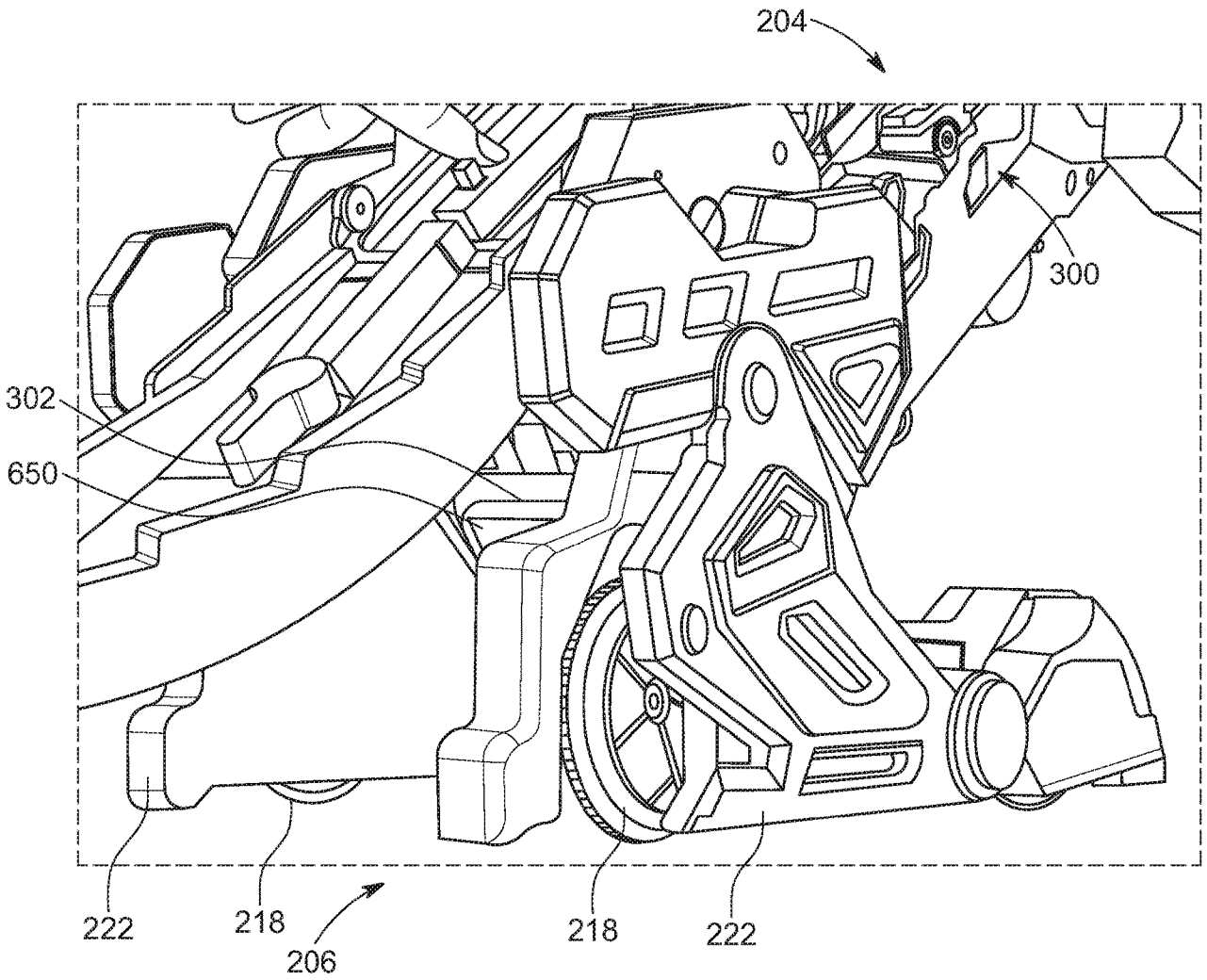
FIGS. 10*a* and 10*b* illustrate perspective rear views of a main body and a base of the toy vehicle carrier of FIGS. 2*a*-2*c;*

FIG. 10*a* illustrates a perspective rear view of the main body 204 and of the base 206 of the toy vehicle carrier 200. In the illustrated embodiment, the main body 204 includes a cover 650 attached to the chassis 302 (e.g., between the base wheels 218 and the appendages 222), and the cover 650 extends across and covers an outlet of the chassis 302. For example, the outlet is configured to expose the interior 300 of the chassis 302 of the main body 204 to a surrounding environment, but the cover 650 blocks exposure of the interior 300 at the outlet. Thus, the cover 650 blocks movement of a toy vehicle 210 out of the interior 300 via the outlet.

Figure 10B:
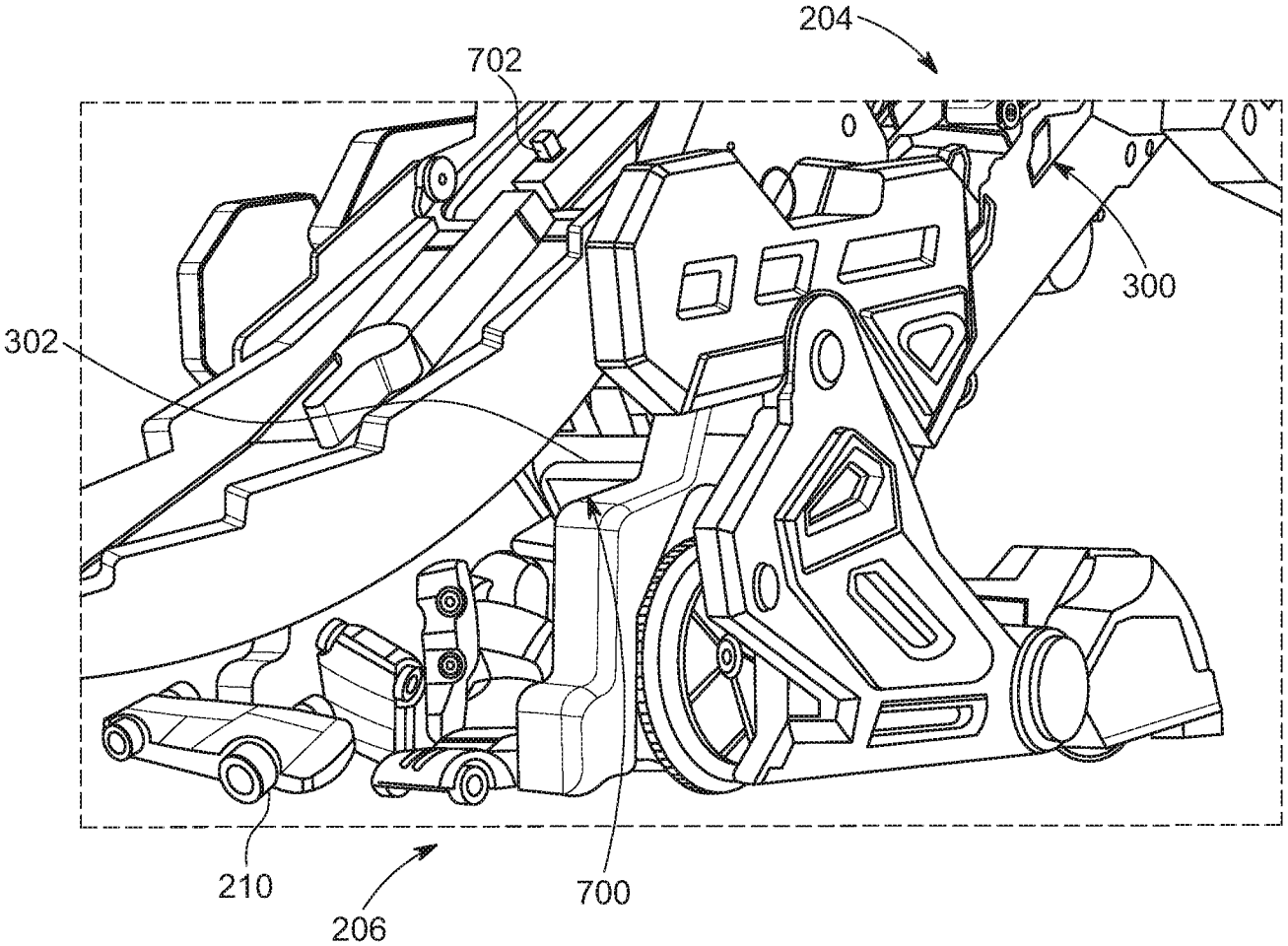

FIG. 10*b* illustrates a perspective rear view of the main body 204 and of the base 206 of the toy vehicle carrier 200 in which the cover 650 is moved and no longer covers an outlet 700 of the chassis 302. Thus, the outlet 700 exposes the interior 300 of the chassis 302 to a surrounding environment. As a result, toy vehicles 210 positioned within the interior 300 may move through the outlet 700 (e.g., via a gravitational force) and out of the interior 300. For example, the outlet 700 is positioned adjacent to the base 206, and the outlet 700 may face toward the surface on which the base 206 is positioned while the toy vehicle carrier 200 is in the second configuration 400 to direct the toy vehicles 210 out of the interior 300 away from the head 202.

In some embodiments, movement of the cover 650 is controlled via a switch 702. As an example, the cover 650 is secured to the chassis 302 to extend across the outlet 700 via a latch, and actuation of the switch 702 releases the cover 650 from the latch to cause the chassis 302 to move (e.g., rotate about the chassis 302) and expose the outlet 700. Although the switch 702 is shown as a button in the illustrated embodiment, any suitable feature, such as a pin, a touch latch, a knob, and so forth, may be used to move the cover 650. In some embodiments, the cover 650 remains attached to the chassis 302 while positioned to expose the outlet 700. In additional or alternative embodiments, the cover 650 is detachable from the chassis 302 to expose the outlet 700. In any case, a user may selectively move the cover 650 relative to the outlet 700 to enable or block movement of the toy vehicles 210 out of the interior 300 via the outlet 700.

Figure 11A:
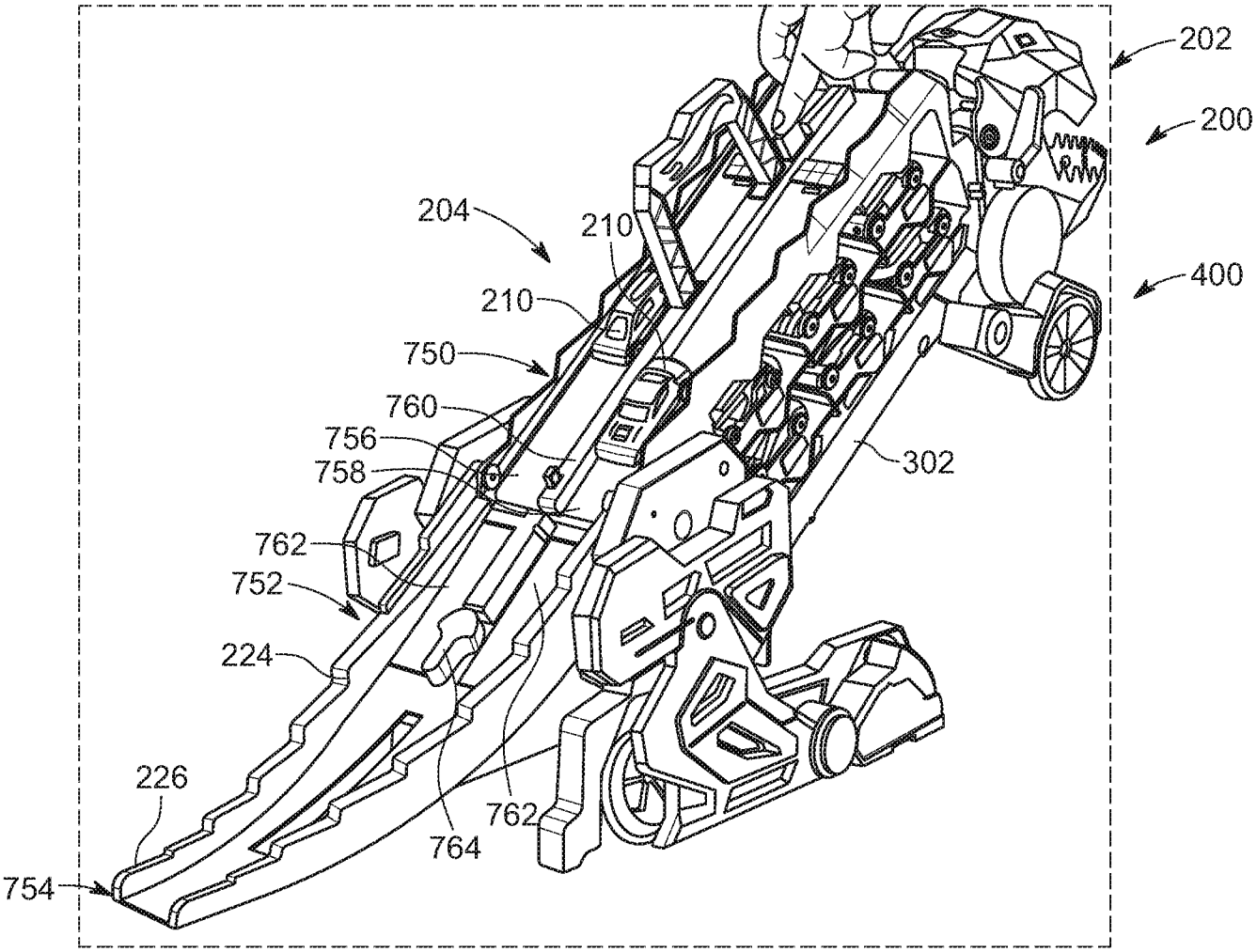
FIGS. 11*a* and 11*b* illustrate perspective rear views of the toy vehicle carrier of FIGS. 2*a*-2*c*.

FIG. 11*a* illustrates a perspective rear view of the toy vehicle carrier 200 in the second configuration 400. The toy vehicle carrier 200 includes a main body track 750 extending along the main body 204 (e.g., coupled to the chassis 302) and an extension track 752 defined by the extension 224. In the second configuration 400 of the toy vehicle carrier 200, the main body track 750 aligns with the extension track 752. Toy vehicles 210 may travel along the main body track 750 and the extension track 752, such as from the main body 204 adjacent to the head 202 and toward the extension 224. The extension track 752 forms an exit 754 at the tip 226 of the extension 224 to eject the toy vehicles 210 from the toy vehicle carrier 200.

In some embodiments, each of the main body track 750 and the extension track 752 includes a first lane 756 and a second lane 758, which may be formed via a partition or wall 760. Each lane 756, 758 is configured to receive a separate toy vehicle 210. For instance, a pair of toy vehicles 210 may concurrently move along the main body track 750 and the extension track 752 in the separate lanes 756, 758 alongside one another. Such interaction of the toy vehicles 210 with the main body track 750 and the extension track 752 may increase entertainment provided by the toy vehicle carrier 200, such as by creating a race-like interaction between different toy vehicles 210.

The extension track 752 further includes doors or gates 762 respectively positioned at each lane 756, 758. Each door 762 is configured to move to create an opening through the extension track 752. Such an opening is sufficiently sized to enable movement of a toy vehicle 210 therethrough. For example, a toy vehicle 210 traveling along the extension track 752 may fall through the opening instead of toward the exit 754. A track actuator 764 positioned on the extension track 752 is configured to cause movement of the doors 762. By way of example, each door 762 may be retained to extend toward the exit 754 via a respective latch, and movement of the track actuator 764 may release one of the respective latches to cause the corresponding door 762 to move (e.g., via a gravitational force) and expose a corresponding opening. Indeed, as further discussed herein, certain movement of the track actuator 764 may cause movement of one of the doors 762 of the lanes 756, 758, but not the other of the doors 762. In this manner, the track actuator 764 can selectively and individually activate the doors 762.

Figure 11B:
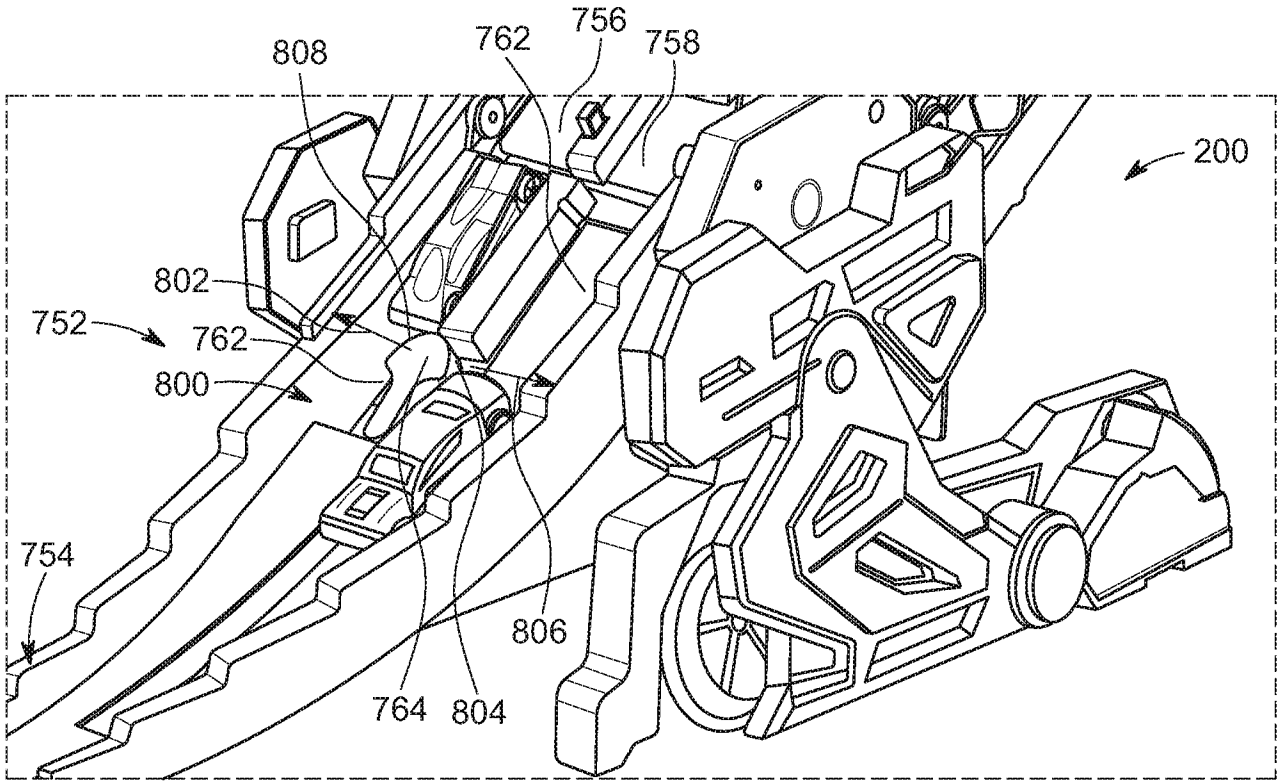

FIG. 11*b* illustrates a perspective rear view of the toy vehicle carrier 200 providing further details regarding the extension track 752. In the illustrated embodiment, the door 762 of the first lane 756 is moved to create an opening 800 in the extension track 752 at the lane 756. However, the door 762 of the second lane 758 remains in position to extend toward the exit 754. As an example, the track actuator 764 is moved to cause the door 762 of the first lane 756, but not the door 762 of the second lane 758, to move.

For instance, movement (e.g., rotation) of the track actuator 764 in a first direction 802 into the first lane 756 causes the door 762 of the first lane 756 to move without causing the door 762 of the second lane 758 to move. The toy vehicle 210 moving through the second lane 758 may drive movement of the track actuator 764 in the first direction 802. For example, the track actuator 764 includes a first camming surface 804 extending into the second lane 758 in an unactuated configuration (e.g., in which the track actuator 764 is not in contact with any toy vehicle 210). Movement of the toy vehicle 210 through the second lane 758 at the extension track 752 (e.g., along the door 762 of the second lane 758) may cause the toy vehicle 210 to contact the first camming surface 804 and impart a force that causes movement of the first camming surface 804 in the first direction 802. As a result, movement of the toy vehicle 210 along the extension track 752 at the second lane 758 causes the door 762 at the first lane 756 to move. However, contact between the toy vehicle 210 and the first camming surface 804 may not disrupt movement of the toy vehicle 210 along the second lane 758. Therefore, the toy vehicle 210 at the second lane 758 may continue to travel along the extension track 752 toward the exit 754.

Similarly, movement of the track actuator 764 in a second direction 806 into the second lane 758 may cause the door 762 of the second lane 758 to move without moving the door 762 of the first lane 756. As an example, the track actuator 764 includes a second camming surface 808 that extends into the first lane 756 in the unactuated configuration, and movement of the toy vehicle 210 through the first lane 756 at the extension track 752 (e.g., along the door 762 of the first lane 756) may cause the toy vehicle 210 to contact the second camming surface 808 and impart a force that causes movement of the track actuator 764 in the second direction 806. That is, movement of the toy vehicle 210 along the extension track 752 at the first lane 756 causes the door 762 at the second lane 758 to move. The toy vehicle 210 at the first lane 756 may then continue to travel along the extension track 752 toward the exit 754.

In this manner, in a situation in which toy vehicles 210 are moving alongside one another through the lanes 756, 758, one of the toy vehicles 210 may contact and actuate the track actuator 764 and continue to move toward the exit 754, whereas the toy vehicle 210 that does not contact the track actuator 764 may fall through the opening created by movement of the door 762 as a result of actuation of the track actuator 764. By way of example, the toy vehicle 210 that is ahead and able to travel along the extension track 752 first may contact the track actuator 764. In this manner, the different movements of the toy vehicles 210 with respect to the extension track 752 (e.g., along the extension track 752, through the extension track 752 via an opening) may further enhance the race-like feature of the main body track 750 and the extension track 752 to increase the entertainment provided by the toy vehicle carrier 200.

Figure 12:
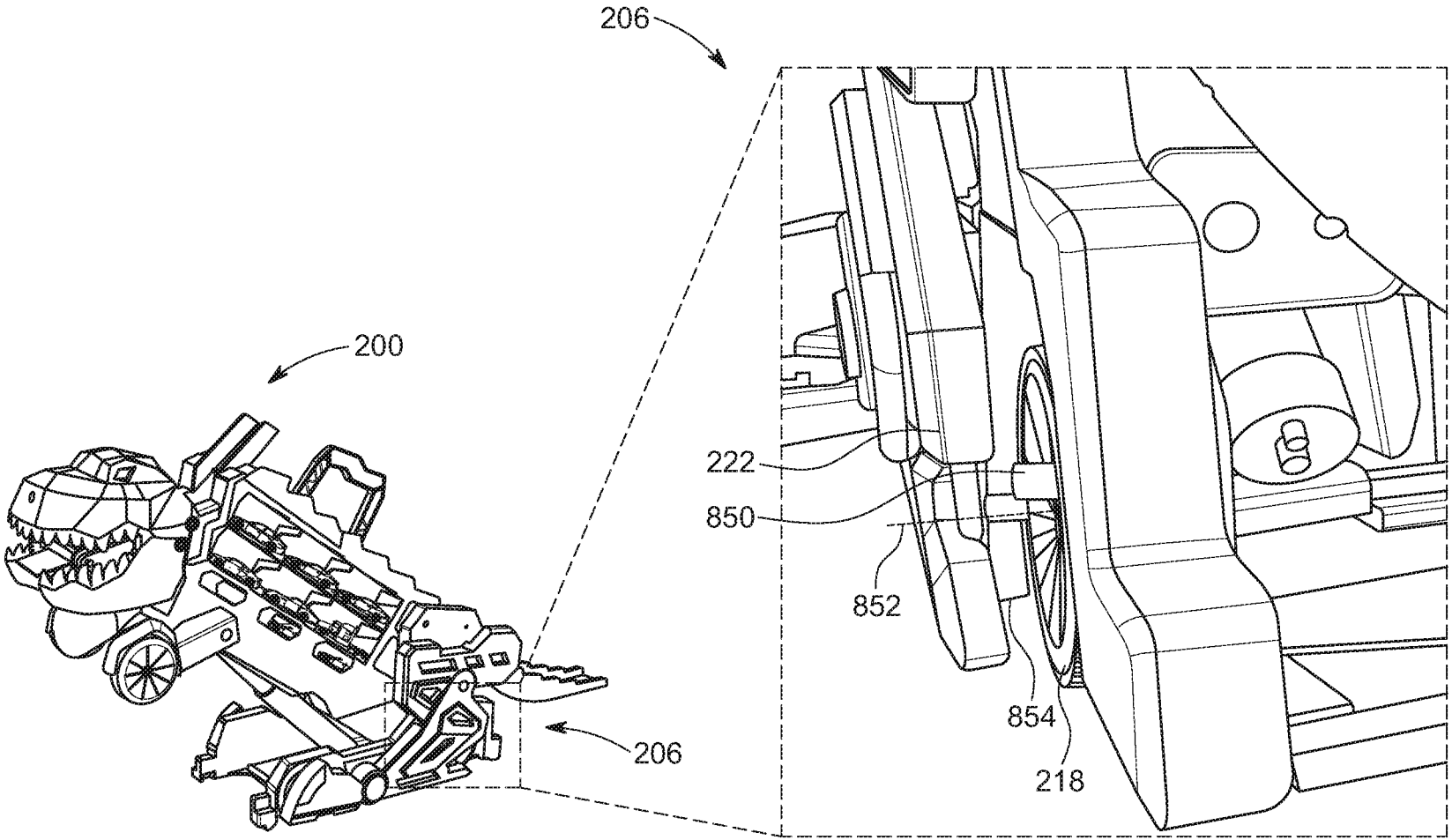
FIG. 12 illustrates a close-up perspective rear view of the base of the toy vehicle carrier of FIGS. 2*a*-2*c*.

FIG. 12 illustrates a perspective rear view of the base 206 of the toy vehicle carrier 200 in the first configuration 220 of the toy vehicle carrier 200. In particular, FIG. 12 illustrates the interface between one of the base wheels 218 and one of the appendages 222 extending over the base wheel 218. As an example, the base wheel 218 positioned farthest away (e.g., most rearward) from the head 202 may be configured to engage the appendage 222. The base wheel 218 includes protrusions 850 that extend laterally outward from the toy vehicle carrier 200 to enable the protrusions 850 to engage the appendage 222. During movement of the toy vehicle carrier 200, the base wheel 218 is configured to rotate about a rotational axis 852. Rotation of the base wheel 218 about the rotational axis 852 causes the protrusions 850 to revolve around the rotational axis 852. Revolution of the protrusions 850 may adjust a distance between the protrusions 850 and the appendage 222. As an example, the protrusions 850 may alternate between moving toward the appendage 222 and away from the appendages 222 during revolution around the rotational axis 852. Thus, the protrusions 850 may movably engage the appendage 222 to drive corresponding movement of the appendages 222.

By way of example, the protrusions 850 are configured to movably engage a camming surface 854 of the appendage 222. In particular, revolution of the protrusions 850 about the rotational axis 852 causes each protrusions 850 to engage the camming surface 854 and drive rotation of the appendage 222 toward the main body 204 and to disengage from the camming surface 854 and enable rotation of the appendage 222 away from the main body 204 (e.g., via a gravitational force). In this manner, the appendage 222 may alternate between rotating toward and away from the main body 204 as a result of rotation of the base wheels 218 to cause the protrusions 850 to movably engage the camming surface 854. As discussed herein, such movement of the appendage 222 may provide an appearance of a gait or walking movement to enhance realistic portrayal of the appendage 222 driving movement of the toy vehicle carrier 200.

The illustrated base wheel 218 includes two protrusions 850 that are spaced at opposite ends of the base wheel 218. That is, the protrusions 850 are circumferentially offset 180 degrees from one another. In this way, the protrusions 850 alternately engage the camming surface 854 to drive movement of the appendages 222. However, in other embodiments, there may be any suitable number of protrusions 850 (e.g., one protrusion 850, three or more protrusions 850) that are positioned in any suitable manner (e.g., evenly or irregularly distributed around the base wheel 218) to movably engage the appendage 222 and cause desirable movement of the appendage 222.

While the toy vehicle carrier presented herein has been illustrated and described in detail and with reference to specific embodiments thereof, it is nevertheless not intended to be limited to the details shown, since it will be apparent that various modifications and structural changes may be made therein without departing from the scope of the disclosure and within the scope and range of equivalents of the claims. In addition, various features from one of the embodiments may be incorporated into another of the embodiments. That is, it is believed that the disclosure set forth above encompasses multiple distinct embodiments with independent utility. While each of these embodiments has been disclosed in a preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Accordingly, it is appropriate that the appended claims be construed broadly and in a manner consistent with the scope of the disclosure as set forth in the following claims.

It is also to be understood that the toy vehicle carrier described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Additionally, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present disclosure to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the disclosure.

Moreover, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially". For example, the term "approximately" can denote a tolerance of plus or minus 0.002 inches, 0.001 inches, or up to 0.005 inches. The same applies to the terms "about" and "around" and "substantially." Moreover, for the purposes of the present disclosure, the phrase "A and/or B" means (A), (B), or (A and B), and the phrase "A, B, and/or C" means (A), (B), (C), (A and B), (A and C), (B and C), or (A, B and C).

Finally, the techniques presented and claimed herein are referenced and applied to material objects and concrete examples of a practical nature that demonstrably improve the present technical field and, as such, are not abstract, intangible, or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A toy vehicle carrier, comprising:

a main body comprising an interior;

a head coupled to the main body, the head defining an opening and a passageway, wherein the head is configured to capture a toy vehicle via the opening and direct the toy vehicle toward the interior of the main body via the passageway;

a base coupled to the main body, wherein the main body is configured to pivot relative to the base about a first axis; and a wheel coupled to the main body and configured to rotate about a second axis, parallel to the first axis, to facilitate movement of the main body along a surface, wherein the main body is configured to pivot relative to the base about the first axis to lift the wheel away from the surface.

2. The toy vehicle carrier of claim 1, wherein the head comprises a roller configured to engage the toy vehicle and rotate about a third axis to direct the toy vehicle toward the interior of the main body.

3. The toy vehicle carrier of claim 2, further comprising:

an actuator, wherein the roller is disposed within the passageway in a first configuration of the head, and the actuator is configured to transition the head from the first configuration to a second configuration and move the roller out of the passageway to avoid contact with the toy vehicle in the second configuration.

4. The toy vehicle carrier of claim 3, wherein the head comprises a track, the track comprises a segment, the segment extends into the passageway in the second configuration to direct the toy vehicle into the passageway toward the opening, and the segment is external to the passageway in the first configuration.

5. The toy vehicle carrier of claim 3, wherein the head comprises a cover and a head base cooperatively defining the opening and the passageway, the actuator is configured to rotate the cover and the head base toward one another to transition the head toward the first configuration, and the actuator is configured to rotate the cover and the head base away from one another to transition the head toward the second configuration.

6. The toy vehicle carrier of claim 1, comprising an additional wheel coupled to the base, wherein the additional wheel is configured to maintain contact with the surface while the main body pivots relative to the base about the first axis to lift the wheel away from the surface.

7. A toy vehicle carrier, comprising:

a head configured to capture and expel a toy vehicle;

a main body coupled to the head and configured to store the toy vehicle captured via the head; and a base coupled to the main body, wherein the main body is configured to rotate relative to the base to transition the toy vehicle carrier between a first configuration and a second configuration, the main body is configured to rotate away from the base to lift the head relative to the base and transition the toy vehicle carrier to the second configuration, and the main body is configured to rotate toward the base to drop the head relative to the base to transition the toy vehicle carrier to the first configuration.

8. The toy vehicle carrier of claim 7, further comprising:

a wheel coupled to the base and configured to rotate to facilitate movement of the base along a surface.

9. The toy vehicle carrier of claim 8, further comprising:

an appendage rotatably coupled to the base, the appendage including a camming surface, wherein the wheel comprises a protrusion, and rotation of the wheel causes the protrusion to movably engage the camming surface of the appendage to cause the appendage to rotate relative to the base.

10. The toy vehicle carrier of claim 7, further comprising:

a piston coupled to the main body and to the base, wherein the piston is configured to support the main body relative to the base to slow rotational movement of the main body with respect to the base in at least one rotational direction.

11. The toy vehicle carrier of claim 7, wherein the main body is configured to rotate toward the base and decrease an angle between the main body and the base to transition the toy vehicle carrier to the first configuration, and the main body is configured to rotate away from the base and increase the angle between the main body and the base to transition the toy vehicle carrier to the second configuration.

12. The toy vehicle carrier of claim 11, further comprising:

an extension rotatably coupled to the main body, wherein the extension is configured to rotate relative to the main body to transition between a compact configuration and an extended configuration, the extension is configured to block rotation of the main body away from the base in the compact configuration, and the extension is configured to block rotation of the main body toward the base in the extended configuration.

13. The toy vehicle carrier of claim 12, wherein the extension extends alongside the main body in the compact configuration, and the extension extends away from the main body in the extended configuration.

14. The toy vehicle carrier of claim 7, further comprising:

a controller and a sound effects module, wherein the controller is configured to cause the sound effects module to output first sound effects while the toy vehicle carrier is in the first configuration, and the controller is configured to cause the sound effects module to output second sound effects, different from the first sound effects, while the toy vehicle carrier is in the second configuration.

15. The toy vehicle carrier of claim 7, wherein the head is coupled to a first end of the main body, the base is coupled to a second end, opposite the first end, of the main body, and the main body comprises an outlet at the second end configured to expel the toy vehicle away from the main body and out of the toy vehicle carrier.

16. The toy vehicle carrier of claim 7, comprising:

a wheel configured to engage a surface and facilitate movement of the toy vehicle carrier along the surface in the first configuration of the toy vehicle carrier; and an arm coupling the wheel to the main body, wherein the main body is configured to rotate away from the base to move the aim away from the surface to transition the toy vehicle carrier to the second configuration and disengage the wheel from the surface in the second configuration.

17. A toy vehicle carrier, comprising:

a main body comprising an interior configured to store a toy vehicle;

a base coupled to the main body, wherein the main body is configured to move relative to the base to transition the toy vehicle carrier between a first configuration and a second configuration; and a head configured to capture the toy vehicle, wherein, in the first configuration, the main body, the base, and the head are at least partially aligned along a common plane so that the main body, the base, and the head are configured to engage a surface, and, in the second configuration, the base extends along a different plane than a plane along which the main body and the head extend so that the base is configured to engage the surface and the main body and the head are configured to extend away from the surface.

18. The toy vehicle carrier of claim 17, comprising:

an appendage coupled to the base and configured to move relative to the base; and a wheel coupled to the base and comprising a protrusion, wherein the wheel is configured to rotate about an axis to cause the protrusion to movably engage the appendage and move the appendage relative to the base, wherein the appendage has a camming surface, and the wheel is configured to rotate about the axis to cause the protrusion to engage the camming surface of the appendage to rotate the appendage relative to the base.

19. The toy vehicle carrier of claim 17, comprising:

an appendage coupled to the base and configured to move relative to the base; and a wheel coupled to the base and comprising a protrusion, wherein the wheel is configured to rotate about an axis to cause the protrusion to movably engage the appendage and move the appendage relative to the base, wherein movement of the main body relative to the base to transition the toy vehicle carrier to the second configuration positions the appendage alongside the wheel to cause the protrusion to movably engage the appendage, and movement of the main body relative to the base to transition the toy vehicle carrier to the first configuration moves the appendage away from the wheel to block the protrusion from movably engaging the appendage.

20. The toy vehicle carrier of claim 19, further comprising:

an extension coupled to the main body, wherein the extension is configured to rotate relative to the main body to enable and block movement of the main body relative to the base to transition the toy vehicle carrier between the first configuration and the second configuration, rotation of the extension away from the main body drives movement of the appendage toward the wheel, and rotation of the extension toward the main body drives movement of the appendage away from the wheel.

21. A toy vehicle carrier, comprising:

a main body comprising an interior configured to store a toy vehicle, wherein the main body comprises a first track configured to receive the toy vehicle;

a base coupled to the main body, wherein the main body is configured to move relative to the base to transition the toy vehicle carrier between a first configuration and a second configuration, wherein in the first configuration, the base extends along the main body, and, in the second configuration, the main body extends away from the base; and an extension coupled to the main body and configured to rotate relative to the main body, wherein the extension comprises a second track configured to receive the toy vehicle, the extension extends along the main body in the first configuration of the toy vehicle carrier, and the extension extends away from the main body in the second configuration of the toy vehicle carrier to align the first track of the main body with the second track of the extension.

22. The toy vehicle carrier of claim 21, wherein the main body comprises a feature configured to release the toy vehicle along the first track towards the second track in the second configuration of the toy vehicle carrier.

23. The toy vehicle carrier of claim 21, further comprising:

a switch extending from the first track of the main body; and a cover configured to block movement of one or more toy vehicles out of the interior of the main body, wherein the switch is configured to actuate the cover to move the cover and expose the interior of the main body to release the one or more toy vehicles from the interior of the main body.

24. The toy vehicle carrier of claim 21, wherein the second track comprises:

a door configured to transition between a first position and a second position, wherein the door covers an opening formed through the second track in the first position, and the door exposes the opening formed through the second track in the second position; and an actuator configured to move the door from the first position to the second position in response to an actuation of the actuator, wherein movement of the toy vehicle along the second track is configured to contact the actuator to cause the actuation of the actuator.

* * * * *